US006598686B1

(12) United States Patent
Zupanick

(10) Patent No.: US 6,598,686 B1
(45) **Date of Patent: *Jul. 29, 2003**

(54) METHOD AND SYSTEM FOR ENHANCED ACCESS TO A SUBTERRANEAN ZONE

(75) Inventor: Joseph A Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 46 days.

This patent is subject to a terminal disclaimer.

(21) Appl. No.: 09/769,098

(22) Filed: Jan. 24, 2001

Related U.S. Application Data

(63) Continuation of application No. 09/696,338, filed on Oct. 24, 2000, now Pat. No. 6,454,000, which is a continuation-in-part of application No. 09/444,029, filed on Nov. 19, 1999, now Pat. No. 6,357,523, which is a continuation-in-part of application No. 09/197,687, filed on Nov. 20, 1998, now Pat. No. 6,280,000.

(51) Int. Cl.[7] ..... E21B 43/00
(52) U.S. Cl. ..... 175/62; 166/52; 166/245
(58) Field of Search ..... 166/50, 52, 245, 166/263; 175/61, 69, 62

(56) References Cited

U.S. PATENT DOCUMENTS

| | | | | |
|---|---|---|---|---|
| 54,144 | A | 4/1866 | Hamar | |
| 274,740 | A | 3/1883 | Douglas | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |

(List continued on next page.)

FOREIGN PATENT DOCUMENTS

| | | | |
|---|---|---|---|
| DE | 197 25 996 A1 | 2/1998 | |
| EP | 0 819 834 A1 | 1/1998 | |
| EP | 0 875 661 A1 | 4/1998 | |
| EP | 0 952.300 A1 | 10/1999 | |
| WO | 94/21889 | 9/1994 | |
| WO | WO 00/31376 | 6/2000 | E21C/41/00 |

OTHER PUBLICATIONS

Susan Eaton, "Reversal of Fortune", New Technology Magazine, pp. 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages).

(List continued on next page.)

*Primary Examiner*—Frank S. Tsay
(74) *Attorney, Agent, or Firm*—Baker Botts L.L.P.

(57) ABSTRACT

A system for enhanced access to subterranean zone from the surface includes a well bore pattern having a first well bore extending from a surface well bore substantially defining a first end of the area in the subterranean zone to a distant end of the area. The pattern also includes a plurality of lateral well bores extending outwardly from the first well bore. The distance from an end of a lateral well bore to the surface well bore may be configured to be substantially equal for each of the lateral well bores to facilitate forming the lateral well bores. The system and method may also include nesting two or more well bore patterns within the subterranean zone to provide uniform coverage of the zone. Additionally, the system and method may include multiple well bore patterns in communication with a common surface well bore to reduce the surface area required for accessing the subterranean zone.

71 Claims, 10 Drawing Sheets

U.S. PATENT DOCUMENTS

| | | | | |
|---|---|---|---|---|
| 2,150,228 | A | 3/1939 | Lamb | 166/10 |
| 2,169,718 | A | 8/1939 | Böll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,847,189 | A | 8/1958 | Shook | 255/76 |
| 2,911,008 | A | 11/1959 | Bois | 137/625.31 |
| 2,980,142 | A | 4/1961 | Turak | 137/637.3 |
| 3,347,595 | A | 10/1967 | Dahms et al. | 299/4 |
| 3,443,648 | A | 5/1969 | Howard | 175/103 |
| 3,473,571 | A | 10/1969 | Dugay | 137/624.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,684,041 | A | 8/1972 | Krammerer, Jr. et al. | 175/267 |
| 3,692,041 | A | 9/1972 | Bondi | 137/238 |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,022,279 | A | 5/1977 | Driver | 166/271 |
| 4,037,658 | A | 7/1977 | Anderson | 166/272 |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,156,437 | A | 5/1979 | Chivens et al. | 137/554 |
| 4,169,510 | A | 10/1979 | Meigs | 175/65 |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,442,896 | A | 4/1984 | Reale et al. | 166/278 |
| 4,494,616 | A | 1/1985 | McKee | 175/67 |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,674,579 | A | 6/1987 | Geller et al. | 175/45 |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,830,105 | A | 5/1989 | Petermann | 166/241 |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/263 |
| 4,978,172 | A | 12/1990 | Schwoebel et al. | 299/12 |
| 5,016,710 | A | 5/1991 | Renard et al. | 166/245 |
| 5,035,605 | A | 7/1991 | Dinerman et al. | 425/564 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,121,244 | A | 6/1992 | Takasaki | 389/161 |
| 5,135,058 | A | 8/1992 | Millgard et al. | 175/71 |
| 5,148,875 | A | 9/1992 | Karlsson et al. | 175/62 |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |
| 5,193,620 | A | 3/1993 | Braddick | 166/382 |
| 5,194,859 | A | 3/1993 | Warren | 340/853.4 |
| 5,194,977 | A | 3/1993 | Nishio | 359/128 |
| 5,197,553 | A | 3/1993 | Leturno | 175/57 |
| 5,197,783 | A | 3/1993 | Theimer et al. | 299/17 |
| 5,199,496 | A | 4/1993 | Redus et al. | 166/366 |
| 5,201,817 | A | 4/1993 | Hailey | 175/269 |
| 5,217,076 | A | 6/1993 | Masek | 166/303 |
| 5,240,350 | A | 8/1993 | Yamaguchi et al. | 405/143 |
| 5,242,017 | A | 9/1993 | Hailey | 166/55.8 |
| 5,246,273 | A | 9/1993 | Rosar | 299/4 |
| 5,255,741 | A | 10/1993 | Alexander | 166/278 |
| 5,271,472 | A | 12/1993 | Leturno | 175/107 |
| 5,301,760 | A | 4/1994 | Graham | 175/61 |
| 5,363,927 | A | 11/1994 | Frank | 175/67 |
| 5,385,205 | A | 1/1995 | Hailey | 166/55.8 |
| 5,394,950 | A | 3/1995 | Gardes | 175/45 |
| 5,402,851 | A | 4/1995 | Baiton | 166/369 |
| 5,411,082 | A | 5/1995 | Kennedy | 166/181 |
| 5,411,085 | A | 5/1995 | Moore et al. | 166/242 |
| 5,411,104 | A | 5/1995 | Stanley | 175/65 |
| 5,411,105 | A | 5/1995 | Gray | 175/69 |
| 5,431,220 | A | 7/1995 | Lennon et al. | 166/55.7 |
| 5,435,400 | A | 7/1995 | Smith | 175/61 |
| 5,450,902 | A | 9/1995 | Matthews | 166/268 |
| 5,454,419 | A | 10/1995 | Vloedman | 166/277 |
| 5,458,209 | A | 10/1995 | Hayes et al. | 175/61 |
| 5,462,116 | A | 10/1995 | Carroll | 166/249 |
| 5,462,120 | A | 10/1995 | Gondouin | 166/380 |
| 5,469,155 | A | 11/1995 | Archambeault et al. | 340/853.4 |
| 5,477,923 | A | 12/1995 | Jordan, Jr. et al. | 166/313 |
| 5,485,089 | A | 1/1996 | Kuckes | 324/346 |
| 5,494,121 | A | 2/1996 | Nackerud | 175/263 |
| 5,501,273 | A | 3/1996 | Puri | 166/252.5 |
| 5,501,279 | A | 3/1996 | Garg et al. | 166/372 |

| | | | | | |
|---|---|---|---|---|---|
| 5,584,605 | A | | 12/1996 | Beard et al. | 405/128 |
| 5,615,739 | A | | 4/1997 | Dallas | 166/306 |
| 5,659,347 | A | | 8/1997 | Taylor | 347/85 |
| 5,669,444 | A | | 9/1997 | Riese et al. | 166/263 |
| 5,680,901 | A | | 10/1997 | Gardes | 166/313 |
| 5,690,390 | A | | 11/1997 | Bithell | 299/4 |
| 5,706,871 | A | | 1/1998 | Andersson et al. | 141/59 |
| 5,720,356 | A | | 2/1998 | Gardes | 175/62 |
| 5,727,629 | A | | 3/1998 | Blizzard, Jr. et al. | 166/298 |
| 5,735,350 | A | | 4/1998 | Longbottom et al. | 166/313 |
| 5,771,976 | A | | 6/1998 | Talley | 166/370 |
| 5,785,133 | A | | 7/1998 | Murray et al. | 175/61 |
| 5,832,958 | A | | 11/1998 | Cheng | 137/625.41 |
| 5,852,505 | A | | 12/1998 | Li | 359/118 |
| 5,853,054 | A | | 12/1998 | McGarian et al. | 175/267 |
| 5,853,056 | A | | 12/1998 | Landers | 175/424 |
| 5,863,283 | A | | 1/1999 | Gardes | 588/250 |
| 5,867,289 | A | | 2/1999 | Gerstel et al. | 359/110 |
| 5,868,202 | A | | 2/1999 | Hsu | 166/256 |
| 5,868,210 | A | | 2/1999 | Johnson et al. | 175/40 |
| 5,879,057 | A | | 3/1999 | Schwoebel et al. | 299/17 |
| 5,884,704 | A | | 3/1999 | Longbottom et al. | 16/313 |
| 5,912,754 | A | | 6/1999 | Koga et al. | 359/179 |
| 5,914,798 | A | | 6/1999 | Liu | 359/161 |
| 5,917,325 | A | | 6/1999 | Smith | 324/326 |
| 5,934,390 | A | | 8/1999 | Uthe | 175/67 |
| 5,957,539 | A | | 9/1999 | Durup et al. | 299/4 |
| 6,012,520 | A | | 1/2000 | Yu et al. | 166/245 |
| 6,024,171 | A | | 2/2000 | Montgomery et al. | 166/308 |
| 6,050,335 | A | | 4/2000 | Parsons | 166/272.3 |
| 6,065,550 | A | | 5/2000 | Gardes | 175/62 |
| 6,119,771 | A | | 9/2000 | Gano et al. | 166/50 |
| 6,135,208 | A | | 10/2000 | Gano et al. | 166/313 |
| 6,280,000 | B1 | * | 8/2001 | Zupanick | 299/12 |
| 6,349,769 | B1 | | 2/2002 | Ohmer | 166/313 |
| 6,357,523 | B1 | * | 3/2002 | Zupanick | 166/52 |
| 6,425,448 | B1 | | 7/2002 | Zupanick et al. | 175/61 |

OTHER PUBLICATIONS

Notification of Transmittal of The International Search Report (PCT Rule 44.1) mailed Jun. 14, 2002 corresponding to International Appln. No. PCT/US02/01325 filed Jan. 18, 2002, Jun. 14, 2002.

R.J. "Bob" Stayton, "Horizontal Wells Boost CBM Recovery", Special Report: Horizontal & Directional Drilling, *The American Oil & Gas Reporter,* pp. 71–75, Aug. 2002.

Kelley et al., U.S. Patent Application Publication No. US 2002/0074122 A1 Method and Apparatus for Hydrocarbon Subterranean Recover, Jun. 20, 2002.

Weiguo Chi & Luwu Yang, "*Feasibility of Coalbed Methane Exploitation in China,*" Horizontal Well Technology, p. 74, Sep. 2001.

Gopal Ramaswamy, "*Production History Provides CBM Insights,*" Oil & Gas Journal pp. 49, 50 & 52, Apr. 2, 2001.

Gopal Ramaswamy, "*Advances Key For Coalbed Methane,*" The American Oil & Gas Reporter, pp. 71 & 73, Oct. 2001.

Pend Pat App, Joseph A. Zupanick et al., "*Method and System for Management of By–Products From Subterranean Zones,*" Ser. No. 10/046001, Oct. 19, 2001.

Pend Pat App, Joseph A. Zupanick, "*Method and System for Accessing Subterranean Deposits From The Surface,*" Ser. No. 09/885,219, Jun. 20, 2001.

Nackerud Product Description.

Arfon H. Jones et al., "A Review of the Physical and Mechanical Properties of Coal with Implications for Coal–Bed Methane Well Completion and Production", *Rocky Mountain Association of Geologists,* pp 169–181, 1988.

Joseph C. Stevens, Horizontal Applications for Coal Bed Methane Recovery, 3rd Annual Coalbed and Coal Mine Conference, *Strategic Research Institute,* pp 1–10 slides, Mar. 25, 2002.

Joseph A. Zupanick; Declaration of Experimental Use, pp 1–3, Nov. 14, 2000.

Howard L. Hartman, et al.; "*SME Mining Engineering Handbook;*" Society for Mining, Metallurgy, and Exploration, Inc.; pp 1946–1950, 2nd Edition, vol. 2, 1992.

Dave Hassan, Mike Chernichen, Earl Jensen, and Morley Frank; "*Multi–lateral technique lowers drilling costs, provides environmental benefits*", Drilling Technology, pp 41–47, Oct. 1999.

PCT Search Report, Oct. 11, 2000.

Pending patent application, Joseph A. Zupanick, *Method for Production of Gas From a Coal Seam,* Ser. No. 09/197,687, filed Nov. 20, 1998.

Pending patent application, Joseph A. Zupanick, *Method and System for Accessing Subterranean Deposits From The Surface,* Ser. No. 09/444,029, filed Nov. 19, 1999.

Pending patent application, Joseph A. Zupanick, *Method and System for Accessing Subterranean Deposits from the Surface,* Ser. No. 09/789,956, filed Feb. 20, 2001.

Pending patent application, Joseph A. Zupanick, *Method and System for Accessing Subterranean Deposits from the Surface,* Ser. No. 09/788,897, filed Feb. 20, 2001.

Pending patent application, Joseph A. Zupanick, *Method and System for Accessing Subterranean Deposits from the Surface,* Ser. No. 09/791,033, filed Feb. 20, 2001.

Pending patent application, Joseph A. Zupanick, "*Cavity Well Positioning System and Method,*" Ser. No. 09/696,338, Oct. 24, 2000.

Pending patent application, Joseph A. Zupanick, "*Method and System for Accessing A Subterrean Zone from a Limited Surface Area,*" Ser. No. 09/773,217, Jan. 30, 2001.

Pending patent application, Joseph A. Zupanick, "*Method and System for Accessing A Subterrean Zone from a Limited Surface Area,*" Ser. No. 09/774,996, Jan. 30, 2001.

McCray and Cole, "*Oil Well Drilling and Technology,*" University of Oklahoma Press, pp 315–319, 1959.

Berger and Anderson, "*Modern Petroleum;*" Penn Well Books, pp 106–108, 1978.

* cited by examiner

METHOD AND SYSTEM FOR ENHANCED ACCESS TO A SUBTERRANEAN ZONE

CROSS REFERENCE TO RELATED APPLICATIONS

This application is a continuation of U.S. patent application Ser. No. 09/696,338, filed Oct. 24, 2000, by Joseph A. Zupanick and entitled "Cavity Well Positioning System and Method" now U.S. Pat. No. 6,454,000, which is a CIP of U.S. patent application Ser. No. 09/444,029 filed Nov. 19, 1999 by Joseph A. Zupanick and entitled "Drainage Pattern with Intersecting Wells Drilled from Surface", now U.S. Pat. No. 6,357,523, which is a CIP of U.S. patent application Ser. No. 09/197,687 filed Nov. 20, 1998 by Joseph A. Zupanick and entitled "Method for Production of Gas From a Coal Sean Using Intersecting Well Bores", now U.S. Pat. No. 6,280,000.

TECHNICAL FIELD OF THE INVENTION

The present invention relates generally to the field of subterranean exploration and drilling and, more particularly, to a method and system for enhanced access to a subterranean zone.

BACKGROUND OF THE INVENTION

Subterranean deposits of coal, whether of "hard" coal such as anthracite or "soft" coal such as lignite or bituminous coal contain substantial quantities of entrained methane gas. Limited production and use of methane gas from coal deposits has occurred for many years. Substantial obstacles, however, have frustrated more extensive development and use of methane gas deposits in coal seams. The foremost problem in producing methane gas from coal seams is that while coal seams may extend over large areas, up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amendable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Horizontal drilling patterns have been tried in order to extend the amount of coal seam exposed to a drill bore for gas extraction. Traditional horizontal drilling techniques, however, require the use of a radiused well bore which presents difficulties in removing the entrained water from the coal seam. The most efficient method for pumping water from a subterranean well, a sucker rod pump, does not work well in horizontal or radiused bores.

Additionally, prior systems generally require a fairly large and level surface area from which to work. As a result, prior methods cannot be used in Appalachia and other very hilly terrain where the largest flat land area may be a wide roadway. Thus, less effective methods must be used, leading to production delays that add to the expense associated with degasifying a coal seam.

SUMMARY OF THE INVENTION

The present invention provides a method and system for accessing subterranean zones from a limited surface area that substantially eliminates or reduces the disadvantages and problems associated with previous systems and methods. In particular, an articulated well bore with a well bore pattern in a subterranean seam extends to cavity wells in communication with the well bore pattern in the seam. The well bore patterns provide access to a large subterranean area while the cavity wells allow entrained water, hydrocarbons, and other deposits collected by the well bore pattern to be efficiently removed and/or produced.

In accordance with one embodiment of the present invention, a subterranean well bore pattern for accessing an area of a subterranean zone from the surface includes a first well bore extending from a surface well bore substantially defining a first end of the area in the subterranean zone to a distant end of the area. The pattern also includes a plurality of lateral well bores extending outwardly from the first well bore. The lateral well bores are configured such that a distance from an end of a lateral well bore to the surface well bore is substantially equal for each of the lateral well bores.

In accordance with another embodiment of the present invention, a method for accessing a subterranean zone from the surface includes forming a first well bore pattern in the form of a first substantially quadrilateral area. The first well bore pattern extends from a surface well bore. The method also includes forming a second well bore pattern in the form of a second substantially quadrilateral area. The second well bore pattern also extends from the surface well bore. The first and second well bore patterns are arranged such that a first side of the first quadrilateral area is disposed substantially in common with a first side of the second quadrilateral area.

In accordance with another embodiment of the present invention, a system for accessing a subterranean zone from the surface includes a surface well bore extending from the surface to the subterranean zone. The system also includes a plurality of well bore patterns disposed within the subterranean zone each extending in a different direction from the surface well bore. The plurality of well bore patterns are symmetrically disposed about the surface well bore.

In accordance with yet another embodiment of the present invention, a method for accessing a subterranean zone from the surface includes forming a first well bore pattern extending from a first surface well bore and disposed within the subterranean zone. The method also includes forming a second well bore pattern extending from a second surface well bore and disposed within the subterranean zone. The first and second well bore patterns are arranged to nest adjacent each other within the subterranean zone.

Technical advantages of the present invention include providing an improved method and system for accessing subterranean zones from a limited area on the surface. In one embodiment, a plurality of well bore patterns are drilled in a target zone from a common articulated surface well in close proximity to a corresponding number of cavity wells. The well bore patterns are interconnected to the cavity wells through which entrained water, hydrocarbons, and other fluids drained from the target zone can be efficiently removed and/or produced. As a result, gas, oil, and other fluids from a large, low pressure or low porosity formation can be efficiently produced at a limited area on the surface. Thus, gas may be recovered from formations underlying rough topology. In addition, environmental impact is minimized as the area to be cleared and used is minimized.

Yet another technical advantage of the present invention includes providing an improved method and system for preparing a coal seam or other subterranean deposit for mining and for collecting gas from the seam after mining operations. In particular, cavity wells and an articulated well are used to degasify a coal seam prior to mining operations. This reduces both needed surface area and underground equipment and activities. This also reduces the time needed to degasify the seam, which minimizes shutdowns due to high gas content. In addition, water and additives may be pumped into the degasified coal seam through the combined well prior to mining operations to minimize dust and other hazardous conditions, improve efficiency of the mining process, and improve the quality of the coal product. After mining, the combined well is used to collect gob gas. As a result, costs associated with the collection of gob gas are minimized to facilitate or make feasible the collection of gob gas from previously mined seams.

Another technical advantage of the present invention includes a system and method for enhanced access to subterranean zones from a limited surface area by nesting well bore patterns within the subterranean zone. For example, in one embodiment of the present invention, each well bore pattern may be formed to access a generally quadrilateral configured area of the zone. Two or more of the well bore patterns may then be nested together to provide uniform and optimum coverage of the zone. Additionally, each nested well bore pattern may be formed from two or more well bore sub-patterns. The well bore sub-patterns generally comprise two or more discreet well bore patterns in communication with a common surface well bore. Thus, a variety of different shaped well bore patterns may be formed and nested together to obtain uniform and optimum coverage of a particular subterranean zone.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
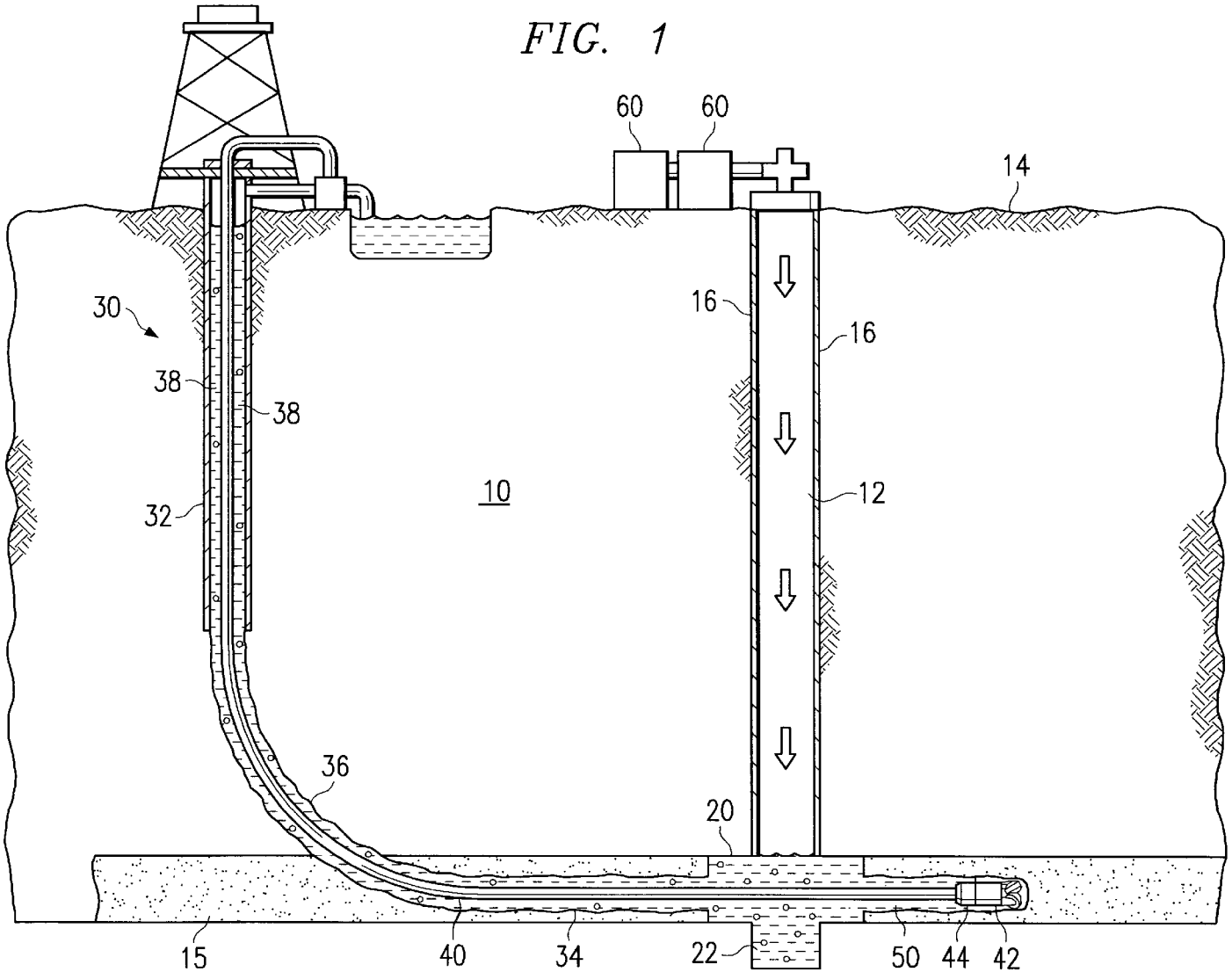
FIG. 1 is a diagram illustrating a cross-sectional view of a system for enhanced access to a subterranean zone in accordance with an embodiment of the present invention.

FIG. 1 is a diagram illustrating a system 10 for enhanced access to a subterranean zone from a limited surface area in accordance with an embodiment of the present invention. In this embodiment, the subterranean zone is a coal seam. It will be understood that other types of zones and/or other types of low pressure, ultra-low pressure, and low porosity subterranean resources can be similarly accessed using the present invention to remove and/or produce water, hydrocarbons and other fluids from the resource, to treat minerals in the resource prior to mining operations, or to inject or introduce a gas, fluid or other substance into the subterranean zone.

System 10 includes a well bore 12 extending from the surface 14 to a target coal seam 15. The well bore 12 intersects, penetrates and continues below the coal seam 15. The well bore 12 is lined with a suitable well casing 16 that terminates at or above the level of the coal seam 15. In FIG. 1, well bore 12 is illustrated substantially vertical; however, it should be understood that well bore 12 may be formed at other suitable angles to accommodate surface 14 characteristics and/or the geometric characteristics of the coal seam 15.

The well bore 12 is logged either during or after drilling in order to locate the exact vertical depth of the coal seam 15. As a result, the coal seam 15 is not missed in subsequent drilling operations and techniques used to locate the coal seam 15 while drilling need not be employed. An enlarged cavity 20 is formed in the well bore 12 proximate the coal seam 15. As described in more detail below, the enlarged cavity 20 provides a junction for intersection of the well bore 12 by an articulated well bore used to form a subterranean well bore pattern in the coal seam 15. The enlarged cavity 20 also provides a collection point for fluids drained from the coal seam 15 during production operations.

In one embodiment, the enlarged cavity 20 has a radius of approximately eight feet and a vertical dimension which equals or exceeds the vertical dimension of the coal seam 15. The enlarged cavity 20 is formed using suitable underreaming techniques and equipment. A portion of the well bore 12 continues below the enlarged cavity 20 to form a sump 22 for the cavity 20.

An articulated well bore 30 extends from the surface 14 to the enlarged cavity 20 of the well bore 12. The articulated well bore 30 includes a portion 32, a portion 34, and a curved or radiused portion 36 interconnecting the portions 32 and 34. In FIG. 1, the portion 32 is illustrated substantially vertical; however it should be understood that portion 32 may be formed at any suitable angle relative to the surface 14 to accommodate surface 14 geometric characteristics and attitudes and/or the geometric configuration or attitude of the coal seam 15. The portion 34 lies substantially in the plane of the coal seam 15 and intersects the enlarged cavity 20 of the well bore 12. In FIG. 1, the plane of the coal seam 15 is illustrated substantially horizontal, thereby resulting in a substantially horizontal portion 34; however, it should be understood that portion 34 may be formed at any suitable angle relative to the surface 14 to accommodate the geometric characteristics of the coal seam 15.

In the embodiment illustrated in FIG. 1, the articulated well bore 30 is offset a sufficient distance from the well bore 12 at the surface 14 to permit the large radius curved section 36 and any desired portion 34 to be drilled before intersecting the enlarged cavity 20. To provide the curved portion 36 with a radius of 100–150 feet, the articulated well bore 30 is offset a distance of about 300 feet from the well bore 12. This spacing minimizes the angle of the curved portion 36 to reduce friction in the articulated well bore 30 during drilling operations. As a result, reach of the articulated drill string drilled through the articulated well bore 30 is maximized. As discussed below, another embodiment of the present invention includes locating the articulated well bore 30 significantly closer to the well bore 12 at the surface 14.

The articulated well bore 30 is drilled using an articulated drill string 40 that includes a suitable down-hole motor and bit 42. A measurement while drilling (MWD) device 44 is included in the articulated drill string 40 for controlling the orientation and direction of the well bore drilled by the motor and bit 42. The portion 32 of the articulated well bore 30 is lined with a suitable casing 38.

After the enlarged cavity 20 has been successfully intersected by the articulated well bore 30, drilling is continued through the cavity 20 using the articulated drill string 40 and appropriate drilling apparatus to provide a subterranean well bore pattern 50 in the coal seam 15. In FIG. 1, the well bore pattern 50 is illustrated substantially horizontal corresponding to a substantially horizontally illustrated coal seam 15; however, it should be understood that well bore pattern 50 may be formed at any suitable angle corresponding to the geometric characteristics of the coal seam 15. The well bore pattern 50 and other such well bores include sloped, undulating, or other inclinations of the coal seam 15 or other subterranean resource. During this operation, gamma ray logging tools and conventional measurement while drilling devices may be employed to control and direct the orientation of the drill bit 42 to retain the well bore pattern 50 within the confines of the coal seam 15 and to provide substantially uniform coverage of a desired area within the coal seam 15.

During the process of drilling the well bore pattern 50, drilling fluid or "mud" is pumped down the articulated drill string 40 and circulated out of the drill string 40 in the vicinity of the bit 42, where it is used to scour the resource formation and to remove formation cuttings. The cuttings are then entrained in the drilling fluid which circulates up through the annulus between the drill string 40 and the walls of well bore 30 until it reaches the surface 14, where the cuttings are removed from the drilling fluid and the fluid is then recirculated. This conventional drilling operation produces a standard column of drilling fluid having a vertical height equal to the depth of the well bore 30 and produces a hydrostatic pressure on the well bore 30 corresponding to the well bore 30 depth. Because coal seams tend to be porous and fractured, they may be unable to sustain such hydrostatic pressure, even if formation water is also present in the coal seam 15. Accordingly, if the full hydrostatic pressure is allowed to act on the coal seam 15, the result may be loss of drilling fluid and entrained cuttings into the formation. Such a circumstance is referred to as an "over-balanced" drilling operation in which the hydrostatic fluid pressure in the well bore 30 exceeds the ability of the formation to withstand the pressure. Loss of drilling fluids in cuttings into the formation not only is expensive in terms of the lost drilling fluids, which must be made up, but it also tends to plug the pores in the coal seam 15, which are needed to drain the coal seam of gas and water.

To prevent over-balance drilling conditions during formation of the well bore pattern 50, air compressors 60 are provided to circulate compressed air down the well bore 12 and back up through the articulated well bore 30. The circulated air will admix with the drilling fluids in the annulus around the articulated drill string 40 and create bubbles throughout the column of drilling fluid. This has the effect of lightening the hydrostatic pressure of the drilling fluid and reducing the down-hole pressure sufficiently that drilling conditions do not become over-balanced. Aeration of the drilling fluid reduces down-hole pressure to approximately 150–200 pounds per square inch (psi). Accordingly, low pressure coal seams and other subterranean resources can be drilled without substantial loss of drilling fluid and contamination of the resource by the drilling fluid.

Foam, which may be compressed air mixed with water, may also be circulated down through the articulated drill string 40 along with the drilling mud in order to aerate the drilling fluid in the annulus as the articulated well bore 30 is being drilled and, if desired, as the well bore pattern 50 is being drilled. Drilling of the well bore pattern 50 with the use of an air hammer bit or an air-powered down-hole motor will also supply compressed air or foam to the drilling fluid. In this case, the compressed air or foam which is used to power the down-hole motor and bit 42 exits the articulated drill string 40 in the vicinity of the drill bit 42. However, the larger volume of air which can be circulated down the well bore 12 permits greater aeration of the drilling fluid than generally is possible by air supplied through the articulated drill string 40.

Figure 2:
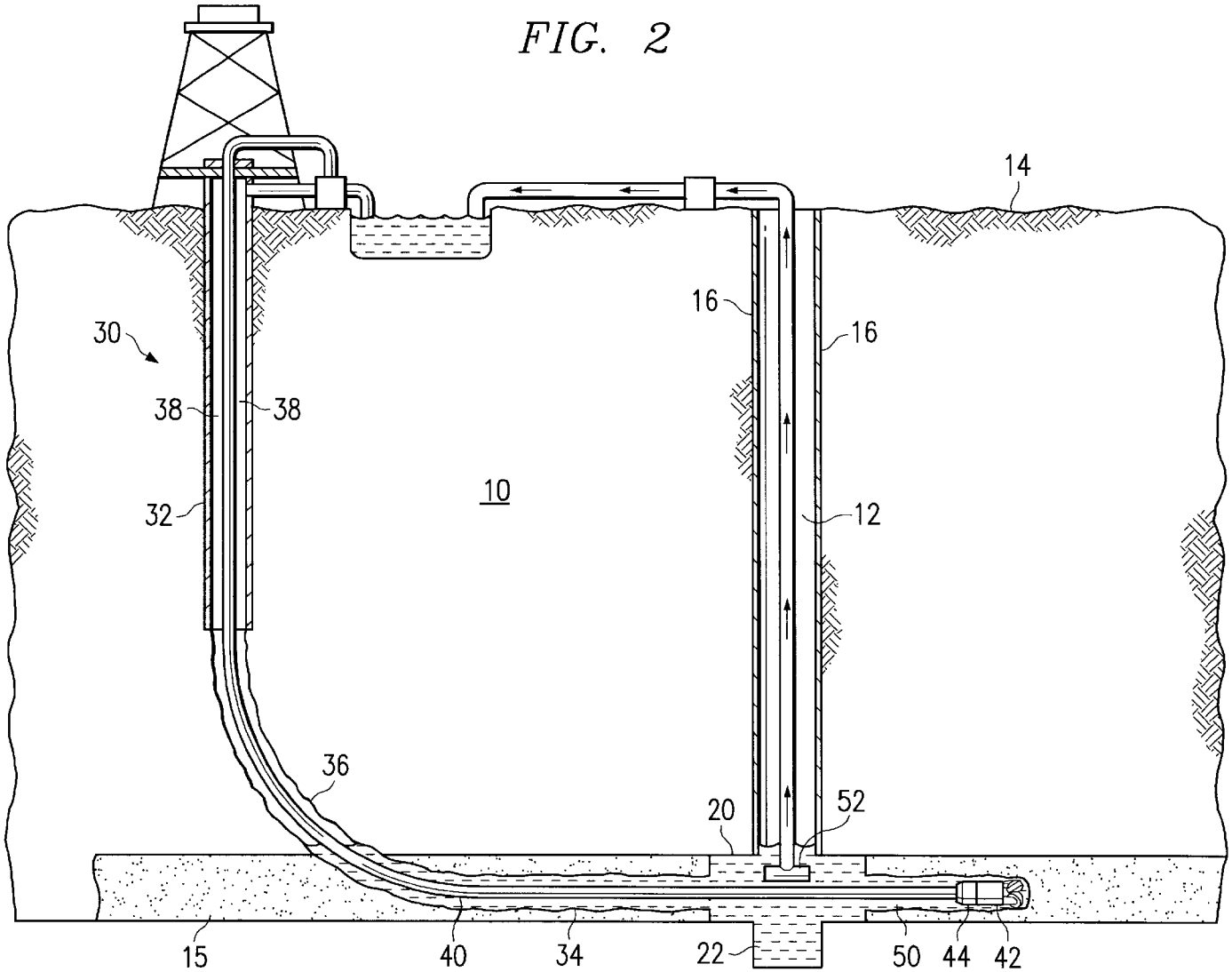
FIG. 2 is a diagram illustrating a cross-sectional view of a system for enhanced access to a subterranean zone in accordance with another embodiment of the present invention.

FIG. 2 is a diagram illustrating system 10 for enhanced access to a subterranean zone from a limited surface area in accordance with another embodiment of the present invention. In this embodiment, the well bore 12, enlarged cavity 20 and articulated well bore 30 are positioned and formed as previously described in connection with FIG. 1. Referring to FIG. 2, after intersection of the enlarged cavity 20 by the articulated well bore 30, a pump 52 is installed in the enlarged cavity 20 to pump drilling fluid and cuttings to the surface 14 through the well bore 12. This eliminates the friction of air and fluid returning up the articulated well bore 30 and reduces down-hole pressure to nearly zero. Accordingly, coal seams and other subterranean resources having ultra low pressures below 150 psi can be accessed from the surface 14. Additionally, the risk of combining air and methane in the well is eliminated.

Figure 3:
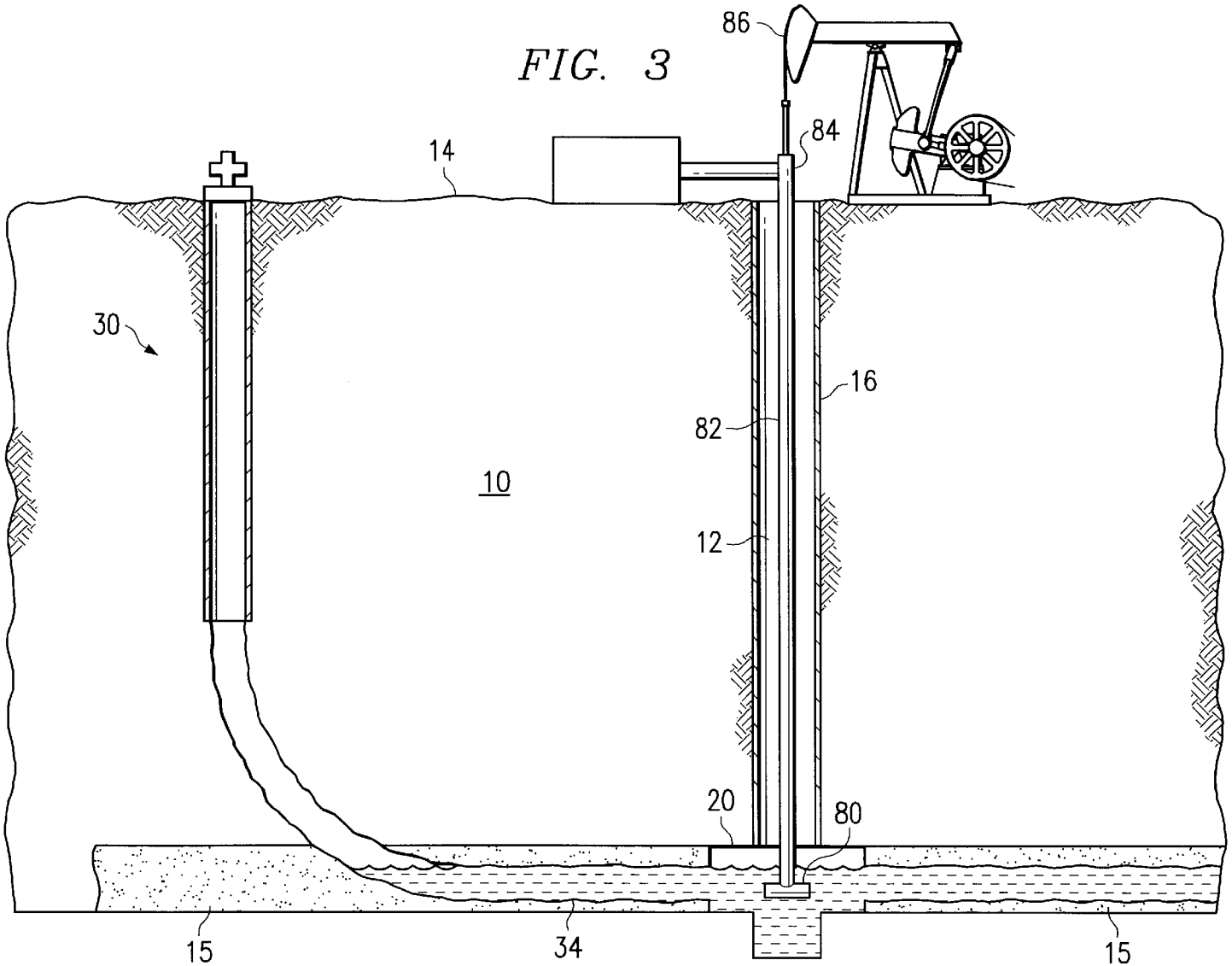
FIG. 3 is a diagram illustrating a cross-sectional view of a system for enhanced access to a subterranean zone in accordance with another embodiment of the present invention.

FIG. 3 is a diagram illustrating system 10 in accordance with another embodiment of the present invention. In this embodiment, after the well bores 12 and 30, as well as well bore pattern 50, have been drilled, the articulated drill string 40 is removed from the articulated well bore 30 and the articulated well bore 30 is capped. A down hole pumping unit 80 is disposed in the well bore 12 in the enlarged cavity 20. The enlarged cavity 20 provides a reservoir for accumulated fluids allowing intermittent pumping without adverse effects of a hydrostatic head caused by accumulated fluids in the well bore 12.

The pumping unit 80 is connected to the surface 14 via a tubing string 82 and may be powered by sucker rods 84 extending down through the well bore 12 of the tubing string 82. The sucker rods 84 are reciprocated by a suitable surface mounted apparatus, such as a powered walking beam 86 to operate the pumping unit 80. The pumping unit 80 is used to remove water and entrained coal fines from the coal seam 15 via the well bore pattern 50. Once the water is removed to the surface 14, it may be treated for separation of methane which may be dissolved in the water and for removal of entrained fines. After sufficient water has been removed from the coal seam 15, pure coal seam gas may be allowed to flow to the surface 14 through the annulus of the well bore 12 around the tubing string 82 and removed via piping attached to a wellhead apparatus. At the surface 14, the methane is treated, compressed and pumped through a pipeline for use as a fuel in a conventional manner. The pumping unit 80 may be operated continuously or as needed to remove water drained from the coal seam 15 into the enlarged cavity 20.

Figure 4:
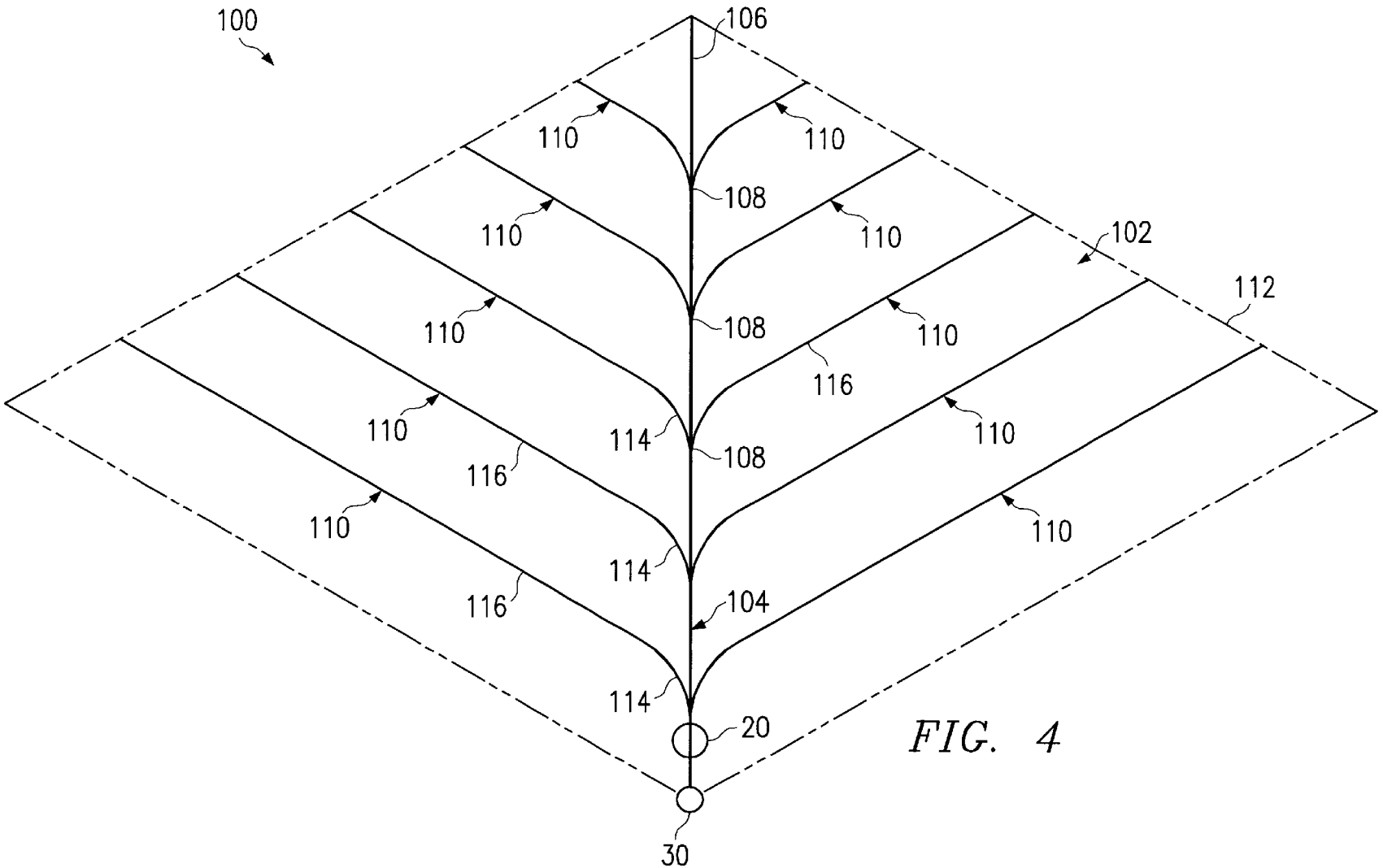
FIG. 4 is a diagram illustrating a plan view of a well bore pattern for accessing a subterranean zone in accordance with an embodiment of the present invention.
Figure 5:
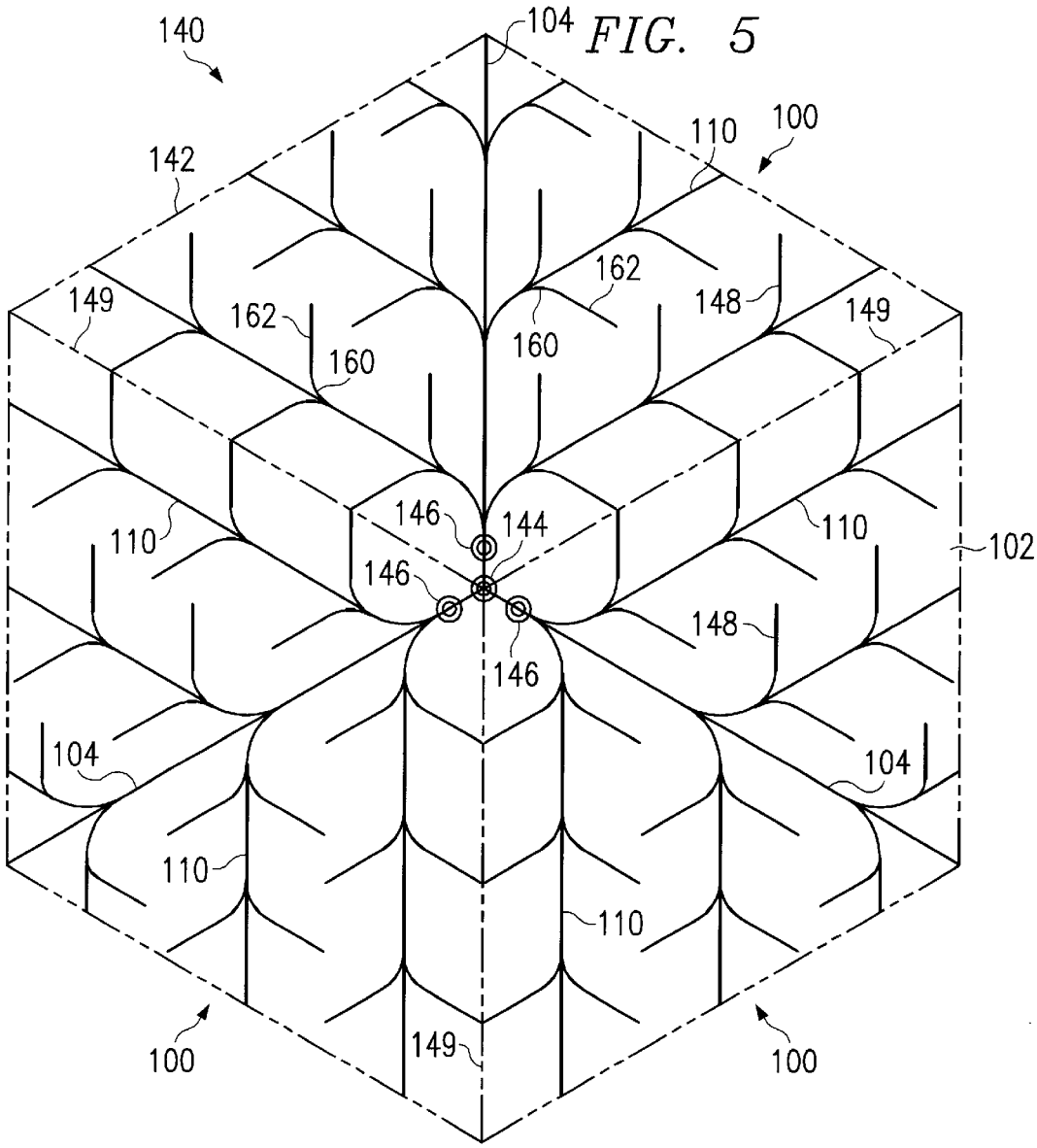
FIG. 5 is a diagram illustrating a tri-pinnate well bore pattern for accessing a subterranean zone in accordance with an embodiment of the present invention.
Figure 6:
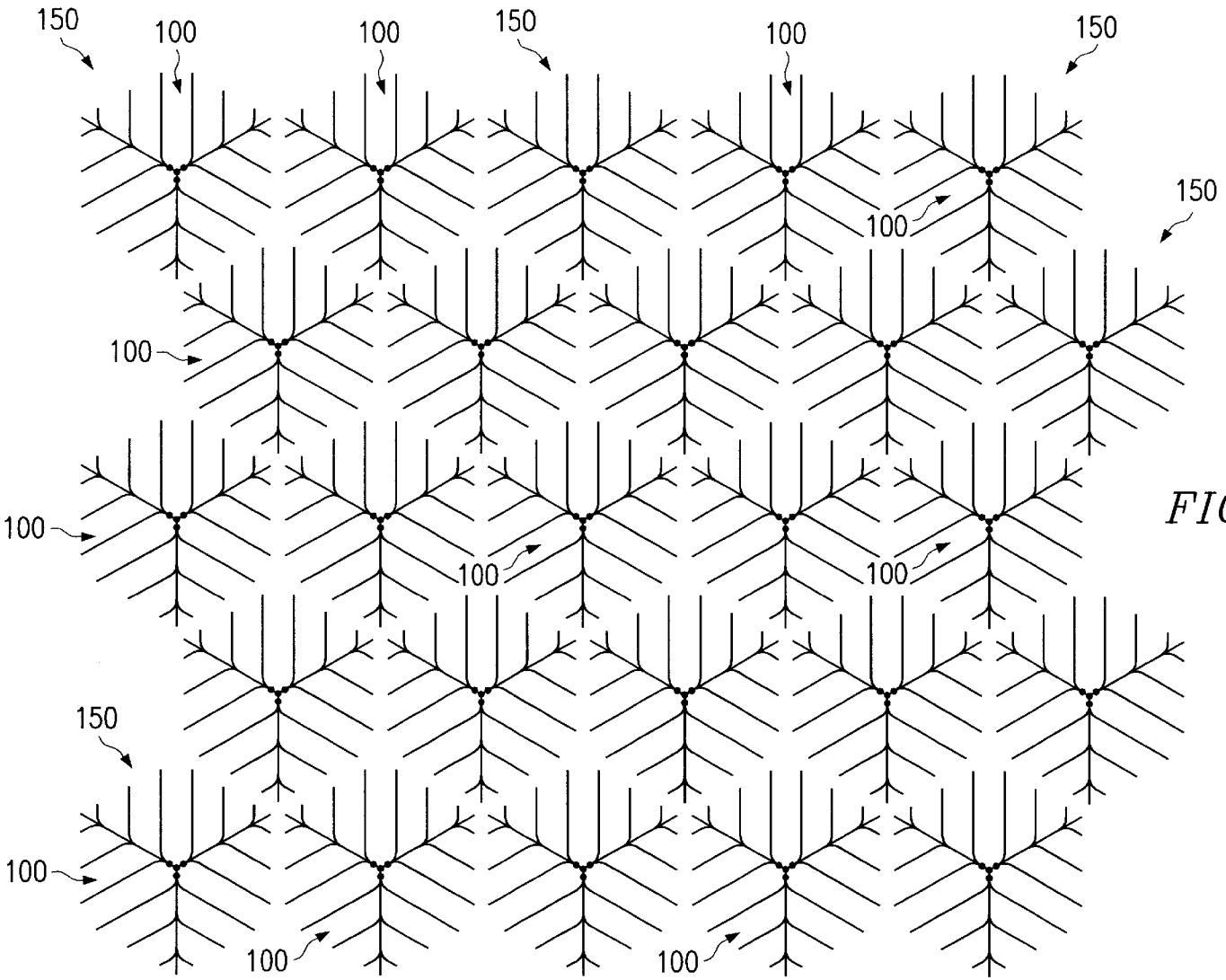
FIG. 6 is a diagram illustrating an alignment pattern of the tri-pinnate well bore pattern illustrated in FIG. 5 in accordance with an embodiment of the present invention.

FIGS. 4–6 are diagrams illustrating well bore patterns 50 for enhanced access to subterranean resources in accordance with embodiments of the present invention. In these embodiments, the well bore patterns 50 comprise pinnate patterns that have a main or central well bore with generally symmetrically arranged and appropriately spaced lateral well bores extending from each side of the main well bore. The pinnate pattern approximates the pattern of veins in a leaf or the design of a feather in that it has similar, substantially parallel, auxiliary well bore bores arranged in substantially equal and parallel spacing on opposite sides of an axis. The pinnate well bore pattern with its main or central bore and generally symmetrically arranged and appropriately spaced auxiliary lateral well bore bores on each side provides a uniform pattern for draining fluids from a coal seam or other subterranean formation or for uniformly introducing a substance into the subterranean formation. As described in more detail below, the pinnate pattern provides substantially uniform coverage of a square, diamond, other quadrilateral, or grid area and may be spaced apart from each other for preparing the coal seam 15 for mining operations. It will be understood that other suitable well bore patterns may be used in accordance with the present invention.

The pinnate and other suitable well bore patterns drilled from the surface provide surface access to subterranean formations. The well bore pattern may be used to uniformly remove and/or insert fluids or otherwise manipulate a subterranean deposit. In non-coal applications, the well bore pattern may be used initiating in-situ burns, "huff-puff" steam operations for heavy crude oil, and the removal of hydrocarbons from low porosity reservoirs.

FIG. 4 is a diagram illustrating a well bore pattern 100 in accordance with an embodiment of the present invention. In this embodiment, the well bore pattern 100 provides access to a substantially diamond or parallelogram-shaped area 102 of a subterranean resource. A number of the well bore patterns 100 may be used together to provide uniform access to a large subterranean region. The articulated well bore 30 defines a first corner of the area 102. The well bore pattern 100 includes a main well bore 104 extending diagonally across the area 102 to a distant corner 106 of the area 102. For drainage applications, the well bores 12 and 30 are positioned over the area 102 such that the well bore 104 is drilled up the slope of the coal seam 15. This will facilitate collection of water, gas, and other fluids from the area 102. The well bore 104 is drilled using the articulated drill string 40 and extends from the enlarged cavity 20 in alignment with the articulated well bore 30.

A plurality of lateral well bores 110 extend from the opposites sides of well bore 104 to a periphery 112 of the area 102. The lateral well bores 110 may mirror each other on opposite sides of the well bore 104 or may be offset from each other along the well bore 104. Each of the lateral well bores 110 includes a radius curving portion 114 extending from the well bore 104 and an elongated portion 116 formed after the curved portion 114 has reached a desired orientation. For uniform coverage of the area 102, pairs of lateral well bores 110 are substantially equally spaced on each side of the well bore 104 and extend from the well bore 104 at an angle of approximately sixty degrees. The lateral well bores 110 shorten in length based on progression away from the enlarged diameter cavity 20 in order to facilitate drilling of the lateral well bores 110. The quantity and spacing of lateral well bores 110 may be varied to accommodate a variety of resource areas, sizes and well bore requirements. For example, lateral well bores 110 may be drilled from a single side of the well bore 104 to form a one-half pinnate pattern.

The well bore 104 and the lateral well bores 110 are formed by drilling through the enlarged cavity 20 using the articulated drill string 40 and an appropriate drilling apparatus. During this operation, gamma ray logging tools and conventional measurement while drilling (MWD) technologies may be employed to control the direction and orientation of the drill bit so as to retain the well bore pattern 100 within the confines of the coal seam 15 and to maintain proper spacing and orientation of the well bore 104 and lateral well bores 110. As illustrated in FIG. 4, the lateral well bores 110 are configured such that a distance or length of each lateral well bore 110 measured from the periphery 112 to the cavity 20 or well bores 12 or 30 is substantially equal, thereby facilitating the drilling of each lateral well bore 110.

In a particular embodiment, the well bore 104 is drilled with an incline at each of a plurality of lateral kick-off points 108. After the well bore 104 is complete, the articulated drill string 40 is backed up to each successive lateral point 108 from which a lateral well bore 110 is drilled on each side of the well bore 104. It should be understood that the well bore pattern 100 may be otherwise suitably formed in accordance with the present invention.

FIG. 5 illustrates a well bore pattern 140 in accordance with another embodiment of the present invention. The well bore pattern 140 includes three discrete well bore patterns 100 each draining a portion of a region 142 covered by the well bore pattern 140. Each of the well bore patterns 100 includes a well bore 104 and a set of lateral well bores 110 extending from the well bore 104. In the tri-pinnate pattern embodiment illustrated in FIG. 5, each of the well bores 104 and 110 are drilled from a common articulated well bore 144 and fluid and/or gas may be removed from or introduced into the subterranean zone through a well bore 146 in communication with each well bore 104. This allows tighter spacing of the surface production equipment, wider coverage of a well bore pattern and reduces drilling equipment and operations.

Each well bore 104 is formed at a location relative to other well bores 104 to accommodate access to a particular subterranean region. For example, well bores 104 may be formed having a spacing or a distance between adjacent well bores 104 to accommodate access to a subterranean region such that only three well bores 104 are required. Thus, the spacing between adjacent well bores 104 may be varied to accommodate varied concentrations of resources of a subterranean zone. Therefore, the spacing between adjacent well bores 104 may be substantially equal or may vary to accommodate the unique characteristics of a particular subterranean resource. For example, in the embodiment illustrated in FIG. 5, the spacing between each well bore 104 is substantially equal at an angle of approximately 120 degrees from each other, thereby resulting in each well bore pattern 100 extending in a direction approximately 120 degrees from an adjacent well bore pattern 100. However, other suitable well bore spacing angles, patterns or orientations may be used to accommodate the characteristics of a particular subterranean resource. Thus, as illustrated in FIG. 5, each well bore 104 and corresponding well bore pattern 100 extends outwardly from well bore 144 in a different direction, thereby forming a substantially symmetrical pattern. As will be illustrated in greater detail below, the symmetrically formed well bore patterns may be positioned or nested adjacent each other to provide substantially uniform access to a subterranean zone.

In the embodiment illustrated in FIG. 5, each well bore pattern 100 also includes a set of lateral well bores 148 extending from lateral well bores 110. The lateral well bores 148 may mirror each other on opposite sides of the lateral well bore 110 or may be offset from each other along the lateral well bore 110. Each of the lateral well bores 148 includes a radius curving portion 160 extending from the lateral well bore 110 and an elongated portion 162 formed after the curved portion 160 has reached a desired orientation. For uniform coverage of the region 142, pairs of lateral well bores 148 may be disposed substantially equally spaced on each side of the lateral well bore 110. Additionally, lateral well bores 148 extending from one lateral well bore 110 may be disposed to extend between or proximate lateral well bores 148 extending from an adjacent lateral well bore 110 to provide uniform coverage of the region 142. However, the quantity, spacing, and angular orientation of lateral well bores 148 may be varied to accommodate a variety of resource areas, sizes and well bore requirements.

As described above in connection with FIG. 4, each well bore pattern 100 generally provides access to a quadrilaterally shaped area or region 102. In FIG. 4, the region 102 is substantially in the form of a diamond or parallelogram. As illustrated in FIG. 5, the well bore patterns 100 may be arranged such that sides 149 of each quadrilaterally shaped region 148 are disposed substantially in common with each other to provide uniform coverage of the region 142.

FIG. 6 illustrates an alignment or nested arrangement of well bore patterns within a subterranean zone in accordance with an embodiment of the present invention. In this embodiment, three discreet well bore patterns 100 are used to form a series of generally hexagonally configured well bore patterns 150, for example, similar to the well bore pattern 140 illustrated in FIG. 5. Thus, the well bore pattern 150 comprises a set of well bore sub-patterns, such as well bore patterns 100, to obtain a desired geometrical configuration or access shape. The well bore patterns 150 may be located relative to each other such that the well bore patterns 150 are nested in a generally honeycomb-shaped arrangement, thereby maximizing the area of access to a subterranean resource using fewer well bore patterns 150. Prior to mining of the subterranean resource, the well bore patterns 150 may be drilled from the surface to degasify the subterranean resource well ahead of mining operations.

The quantity of discreet well bore patterns 100 may also be varied to produce other geometrically-configured well bore patterns such that the resulting well bore patterns may be nested to provide uniform coverage of a subterranean resource. For example, in FIGS. 5–6, three discreet well bore patterns 100 are illustrated in communication with a central well bore 104, thereby forming a six-sided or hexagonally configured well bore pattern 140 and 150. However, greater or fewer than three discreet well bore patterns 100 may also be used in communication with a central well bore 104 such that a plurality of the resulting multi-sided well bore patterns may be nested together to provide uniform coverage of a subterranean resource and/or accommodate the geometric characteristics of a particular subterranean resource.

Figure 7B:
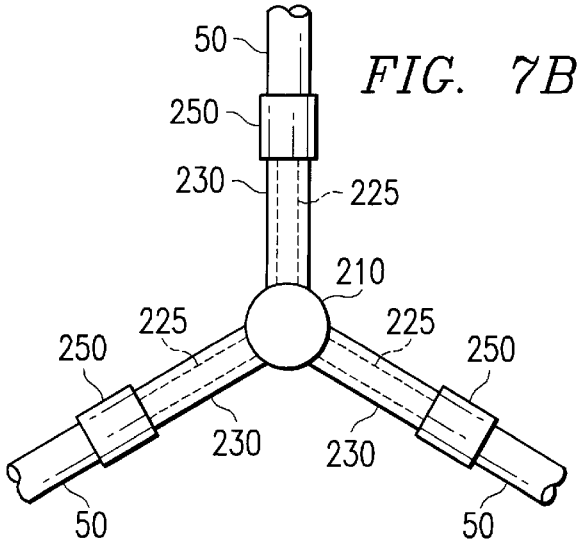
FIG. 7B is a diagram illustrating a plan view of the system for enhanced access to a subterranean zone illustrated in FIG. 7A in accordance with an embodiment of the present invention.
Figure 7A:
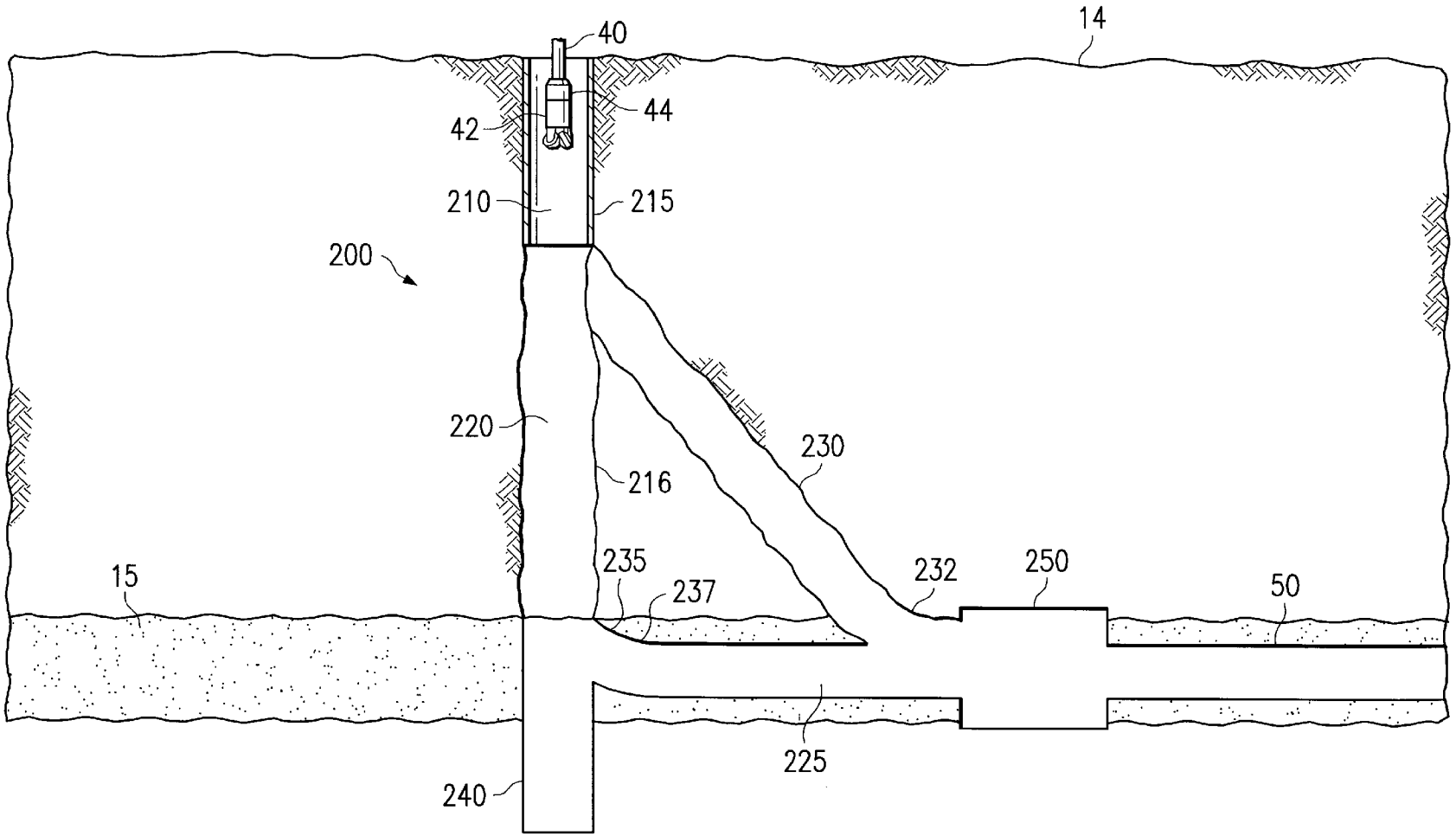
FIG. 7A is a diagram illustrating a cross-sectional view of a system for enhanced access to a subterranean zone in accordance with another embodiment of the present invention.

FIGS. 7A and 7B illustrate a dual radius articulated well system 200 for enhanced access to a subterranean resource from a limited surface area in accordance with another embodiment of the present invention. In this embodiment, the subterranean resource is a coal seam. It should be understood that other subterranean formations and/or other low pressure, ultra-low pressure, and low porosity subterranean resources can be similarly accessed using the dual radius articulated well system 200 of the present invention to remove and/or produce water, hydrocarbons and other fluids in the resource, to treat minerals in the resource prior to mining operations, or to introduce or inject a fluid into the subterranean zone. In this embodiment, three discreet well bore patterns are formed in communication with a single well bore. For ease of illustration, formation of a single well bore pattern is described in conjunction with FIG. 7A; however, it should be understood that the formation of the well bore pattern may be duplicated for forming the additional well bore patterns.

FIG. 7A is a diagram illustrating a cross-sectional view of the system 200 in accordance with an embodiment of the present invention. A well bore 210 extends from the surface 14 to a first articulated well bore 230. The well bore 210 is lined with a suitable well casing 215 that terminates at or above the level of the articulated well bore 230. A second well bore 220 extends from the intersection of the well bore 210 and the first articulated well bore 230 to a second articulated well bore 235. The second well bore 220 is in substantial alignment with the first well bore 210, such that together they form a continuous well bore. An extension 240 to the second well bore 220 extends from the intersection of the second well bore 220 and a second articulated well bore 235 to a depth below the coal seam 15. In FIG. 7A, well bores 210 and 220 are illustrated substantially vertical; however, it should be understood that well bores 210 and 220 may be formed having other angular orientations to accommodate surface 14 and/or coal seam 15 geometric characteristics.

The first articulated well bore 230 includes a radius portion 232. The second articulated well bore 235 includes a radius portion 237. The radius portion 237 is generally sized smaller than radius portion 232 to accommodate intersection of the second articulated well bore 235 with the first articulated well bore 230. The first articulated well bore 230 communicates with an enlarged cavity 250. The enlarged cavity 250 is formed at the distal end of the first articulated well bore 230 at the level of the coal seam 15. As described in more detail below, the enlarged cavity 250 provides a junction for intersection of a subsurface channel or well bore 225.

In one embodiment, the enlarged cavity 250 is formed having a radius of approximately eight feet and a vertical dimension which equals or exceeds the vertical dimension of the coal seam 15. The enlarged cavity 250 is formed using suitable under-reaming techniques and equipment. However, the enlarged cavity 250 may be formed having other suitable geometric characteristics to accommodate fluid accumulation within the enlarged cavity 250.

The well bore 225 is formed at the intersection of the second well bore 220 and the second articulated well bore 235. The well bore 225 extends through the coal seam 15 and into the enlarged cavity 250. In FIG. 7A, well bore 225 is illustrated substantially horizontal; however, it should be understood that well bore 225 may be formed at other angular orientations to accommodate the geometric characteristics of the coal seam 15. After the first articulated well bore 230 is formed, the enlarged cavity 250 is formed in the coal seam. After the enlarged cavity 250 has been formed, drilling is continued through the cavity 250 to form a well bore pattern 50 in the coal seam 15. The well bore pattern 50 and other such well bores include sloped, undulating, or other inclinations of the coal seam 15 or other subterranean resource. During this operation, gamma ray logging tools and conventional measurement while drilling devices may be employed to control and direct the orientation of drilling to retain the well bore pattern 50 within the confines of the coal seam 15 and to provide substantially uniform coverage of a desired area within the coal seam 15. The well bore pattern 50 may include a pattern as illustrated in FIGS. 4–6; however, other suitable well bore patterns may also be used. Drilling mud and over-balance prevention operations may be conducted in the same manner as described in connection with FIGS. 1–3.

After the well bore pattern 50 has been formed, the second well bore 220 may be formed. As described above, the second well bore 220 is formed at the intersection of the first well bore 210 and the first articulated well bore 230. After the well bore 220 is drilled to the depth of the coal seam 15, the second articulated well bore 235 and the well bore 225 are formed. The second articulated well bore 235 is formed using conventional articulated drilling techniques. The well bore 225 is formed using conventional drilling techniques and interconnects the second well bore 220 and the enlarged cavity 250 through the second articulated well bore 235. Fluids collected from the well bore pattern 50 flow through the enlarged cavity 250 and along the well bore 225 and are removed via the second well bore 220 and the first well bore 210 to the surface 14. By drilling in this manner, a substantial area of a subsurface formation may be drained or accessed from a small area on the surface.

FIG. 7B is a diagram illustrating a top plan view of system 200 illustrated in FIG. 7A in accordance with an embodiment of the present invention. As illustrated in FIG. 7B, each of three articulated well bores 230 and well bores 225 extend from well bore 210 in a position approximately 120 degrees apart from each other. Well bore 210 is drilled in a surface location at the approximate center of a desired total well bore area. As described above, articulated well bores 230 are drilled from a surface location proximate to or in common with the well bore 210. Well bore patterns 50 are drilled within the target subterranean resource from each articulated well bore 230. Also from each of the articulated well bores 230, an enlarged cavity 250 is formed to collect resources draining from the well bore patterns 50. Each of three subsurface channel or well bores 225 is drilled to connect each of the enlarged cavities 250 with the well bore 210 as described above in connection with FIG. 7A.

Resources from the target subterranean resource drain into well bore patterns 50, where the resources are collected in the enlarged cavities 250. From the enlarged cavities 250, the resources pass through the well bores 225 and into the well bore 210. Once the resources have been collected in the well bore 210, they may be removed to the surface by the methods as described above.

Figure 8:
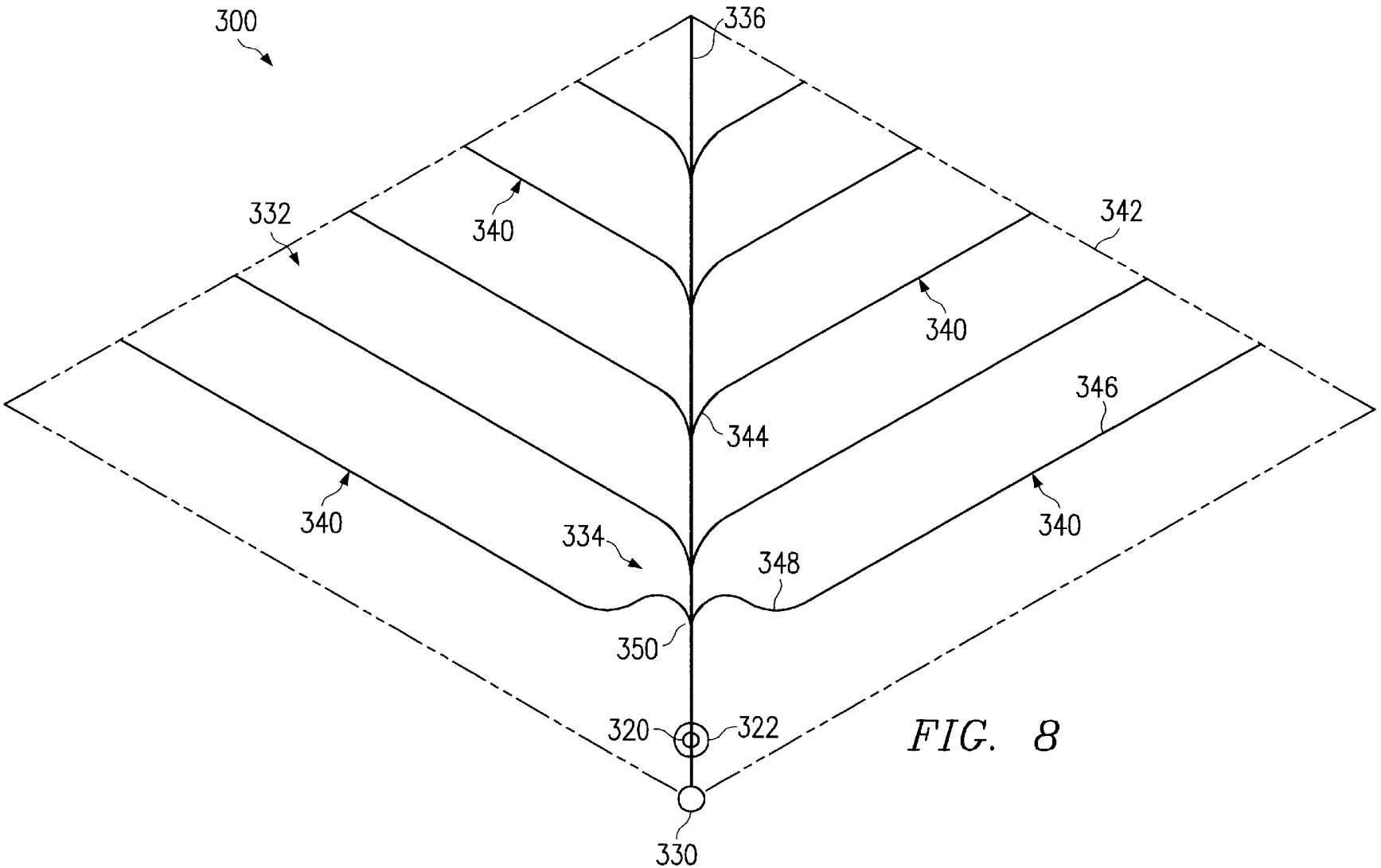
FIG. 8 is a diagram illustrating a plan view of a well bore pattern for accessing a subterranean zone in accordance with another embodiment of the present invention.

FIG. 8 illustrates a well bore pattern 300 in the form of a pinnate pattern in accordance with another embodiment of the present invention. In this embodiment, an articulated well bore 330 defines a first corner of an area 332 of the resource. The well bore pattern 300 includes a main well bore 334 extending diagonally across the area 332 to a distant corner 336 of the area 332. Preferably, a well bore 320 and the articulated well bore 330 are positioned over the area 332 such that the well bore 334 is drilled up the slope of the coal seam 15. This will facilitate collection of water, gas, and other fluids from the area 332. The well bore 334 extends from an enlarged cavity 322 in alignment with the articulated well bore 330.

A plurality of lateral well bores 340 extend from the opposites sides of well bore 334 to a periphery 342 of the area 332. The lateral well bores 340 may mirror each other on opposite sides of the well bore 334 or may be offset from each other along the well bore 334. Each of the lateral well bores 340 includes a first radius curving portion 344 extending from the well bore 304, and an elongated portion 346. The first set of lateral well bores 340 located proximate to the cavity 322 may also include a second radius curving portion 348 formed after the first curved portion 344 has reached a desired orientation. In this set, the elongated portion 346 is formed after the second curved portion 348 has reached a desired orientation. Thus, the first set of lateral well bores 340 kicks or turns back towards the enlarged diameter cavity 322 before extending outward through the formation, thereby extending the well bore area back towards the cavity 322 to provide uniform coverage of the area 332. For uniform coverage of the area 332, pairs of lateral well bores 340 are substantially evenly spaced on each side of the well bore 334 and extend from the well bore 334 at an angle of approximately 60 degrees. The lateral well bores 340 shorten in length based on progression away from the enlarged diameter cavity 322 in order to facilitate drilling of the lateral well bores 340.

The well bore 334 and the lateral well bores 340 are formed by drilling through the enlarged cavity 322 using the articulated drill string 40 and an appropriate drilling apparatus. During this operation, gamma ray logging tools and conventional measurement while drilling (MWD) technologies may be employed to control the direction and orientation of the drill bit so as to retain the well bore pattern 300 within the confines of the coal seam 15 and to maintain proper spacing and orientation of the well bore 334 and lateral well bores 340. In a particular embodiment, the well bore 334 is drilled with an incline at each of a plurality of lateral kick-off points 350. After the well bore 334 is complete, the articulated drill string 40 is backed up to each successive lateral point 350 from which a lateral well bore 340 is drilled on each side of the well bore 334. It will be understood that the pinnate well bore pattern 300 may be otherwise suitably formed in accordance with the present invention.

Figure 9:
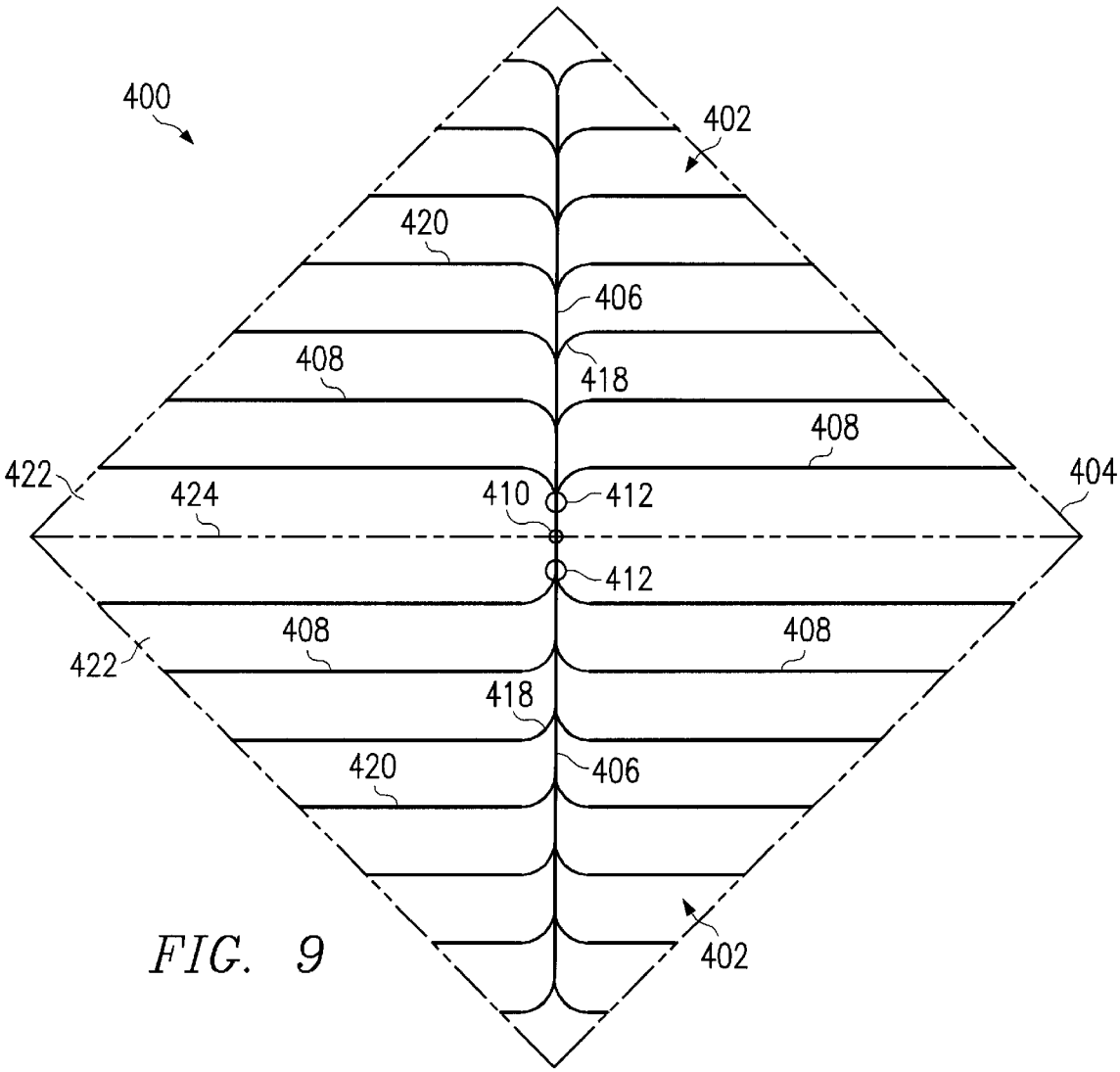
FIG. 9 is a diagram illustrating a plan view of a well bore pattern for accessing a subterranean zone in accordance with another embodiment of the present invention.

FIG. 9 is a diagram illustrating a plan view of a well bore pattern 400 in accordance with an embodiment of the present invention. In this embodiment, well bore pattern 400 comprises two discreet well bore patterns 402 each providing access to a portion of a region 404 covered by the well bore pattern 400. Each of the well bore patterns 402 includes a well bore 406 and a set of lateral well bores 408 extending from the well bore 406. In the embodiment illustrated in FIG. 9, each of the well bores 406 and 408 are drilled from a common articulated well bore 410 and fluid and/or gas may be removed from or introduced into the subterranean zone through a well bore 412 in communication with each well bore 406. In this embodiment, the well bores 410 and 412 are illustrated offset from each other; however, it should be understood that well bore pattern 400 may also be formed using a common surface well bore configuration, such as illustrated in FIG. 7A. This allows tighter spacing of the surface production equipment, wider coverage of a well bore pattern and reduces drilling equipment and operations.

Referring to FIG. 9, the well bores 406 are disposed substantially opposite each other at an angle of approximately 180 degrees, thereby resulting in each well bore pattern 402 extending in an opposite direction. However, other suitable well bore spacing angles, patterns or orientations may be used to accommodate the characteristics of a particular subterranean resource. In the embodiment illustrated in FIG. 9, each well bore pattern 402 includes lateral well bores 408 extending from well bores 406. The lateral well bores 408 may mirror each other on opposite sides of the well bores 406 or may be offset from each other along the well bores 406. Each of the lateral well bores 408 includes a radius curving portion 418 extending from the well bore 406 and an elongated portion 420 formed after the curved portion 418 has reached a desired orientation. For uniform coverage of the region 404, pairs of lateral well bores 408 may be disposed substantially equally spaced on each side of the well bore 406. However, the quantity, spacing, and angular orientation of lateral well bores 408 may be varied to accommodate a variety of resource areas, sizes and well bore requirements. As described above, the lateral well bores 408 may be formed such that the length of each lateral well bore 408 decreases as the distance between each respective lateral well bore 408 and the well bores 410 or 412 increases. Accordingly, the distance from the well bores 410 or 412 to a periphery of the region 404 along each lateral well bore 408 is substantially equal, thereby providing ease of well bore formation.

In this embodiment, each well bore pattern 402 generally provides access to a triangular shaped area or region 422. The triangular shaped regions 422 are formed by disposing the lateral well bores 408 substantially orthogonal to the well bores 406. The triangular shaped regions 422 are disposed adjacent each other such that each region 422 has a side 424 substantially in common with each other. The combination of regions 422 thereby forms a substantially quadrilateral shaped region 404. As described above, multiple well bore patterns 400 may be nested together to provide substantially uniform access to subterranean zones.

Figure 10:
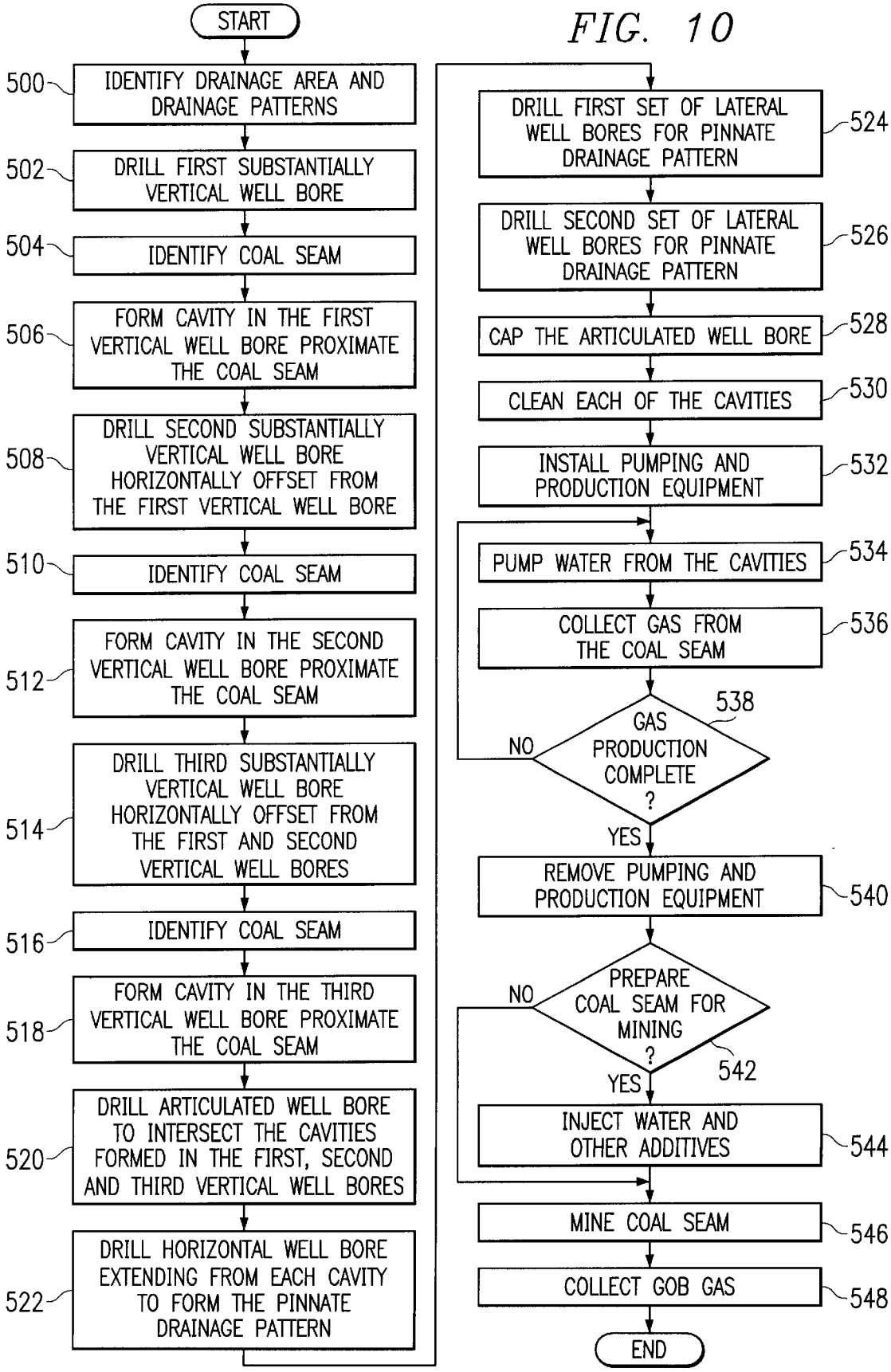
FIG. 10 is a flow diagram illustrating a method for enhanced access to a subterranean zone in accordance with an embodiment of the present invention.

FIG. 10 is a flow diagram illustrating a method for enhanced access to a subterranean resource, such as a coal seam 15, in accordance with an embodiment of the present invention. In this embodiment, the method begins at step 500 in which areas to be drained and well bore patterns for the areas are identified. Pinnate well bore patterns may be used to provide optimized coverage for the region. However, it should be understood that other suitable well bore patterns may also be used.

Proceeding to step 502, the first well bore 12 is drilled from the surface 14 to a predetermined depth through the coal seam 15. Next, at step 504, down hole logging equipment is utilized to exactly identify the location of the coal seam in the well bore 12. At step 506, the enlarged cavity 22 is formed in the first well bore 12 at the location of the coal seam 15. As previously discussed, the enlarged cavity 20 may be formed by under reaming and other conventional techniques.

At step 508, a second well bore 12 is drilled from the surface 14 to a predetermined depth through the coal seam 15. The second well bore 12 is disposed offset from the first well bore 12 at the surface 14. Next, at step 510, down hole logging equipment is utilized to exactly identify the location of the coal seam in the second well bore 12. At step 512, the enlarged cavity 22 is formed in the second well bore 12 at the location of the coal seam 15. At step 514, a third well bore 12 is drilled from the surface 14 to a predetermined depth through the coal seam 15. The third well bore 12 is disposed offset for the first and second well bores 12 at the surface. For example, as described above the first, second and third well bores 12 may be disposed having an approximately 120 degree spacing relative to each other and be equally spaced from a median location of a well bore area. Next, at step 516, down hole logging equipment is utilized to exactly identify the location of the coal seam 15 in the third well bore 12. At step 518, the enlarged cavity 22 is formed in the third well bore 12 at the location of the coal seam 15.

Next, at step 520, the articulated well bore 30 is drilled to intersect the enlarged cavities 22 formed in the first, second and third well bores 12. At step 522, the well bores 104 for the pinnate well bore patterns are drilled through the articulated well bore 30 into the coal seam 15 extending from each of the enlarged cavities 20. After formation of the well bore 104, lateral bores 110 for the pinnate well bore pattern are drilled at step 524. Lateral well bores 148 for the pinnate well bore pattern are formed at step 526.

At step 528, the articulated well bore 30 is capped. Next, at step 530, the enlarged cavities 22 are cleaned in preparation for installation of downhole production equipment. The enlarged cavities 22 may be cleaned by pumping compressed air down the first, second and third well bores 12 or other suitable techniques. At step 532, production equipment is installed in the first, second and third well bores 12. The production equipment may include a sucker rod pump extending down into the cavities 22 for removing water from the coal seam 15. The removal of water will drop the pressure of the coal seam and allow methane gas to diffuse and be produced up the annulus of the first, second and third well bores 12.

Proceeding to step 534, water that drains from the well bore patterns into the cavities 22 is pumped to the surface 14. Water may be continuously or intermittently pumped as needed to remove it from the cavities 22. At step 536, methane gas diffused from the coal seam 15 is continuously collected at the surface 14. Next, at decisional step 538, it is determined whether the production of gas from the coal seam 15 is complete. In one embodiment, the production of gas may be complete after the cost of the collecting the gas exceeds the revenue generated by the well. In another embodiment, gas may continue to be produced from the well until a remaining level of gas in the coal seam 15 is below required levels for mining operations. If production of the gas is not complete, the method returns to steps 534 and 536 in which water and gas continue to be removed from the coal seam 15. Upon completion of production, the method proceeds to step 540 in which the production equipment is removed.

Next, at decisional step 542, it is determined whether the coal seam 15 is to be further prepared for mining operations. If the coal seam 15 is to be further prepared for mining operations, the method proceeds to step 544, where water and other additives may be injected back into the coal seam 15 to rehydrate the coal seam 15 in order to minimize dust, improve the efficiency of mining, and improve the mined product.

If additional preparation of the coal seam 15 for mining is not required, the method proceeds from step 542 to step 546, where the coal seam 15 is mined. The removal of the coal from the coal seam 15 causes the mined roof to cave and fracture into the opening behind the mining process. The collapsed roof creates gob gas which may be collected at step 548 through the first, second and third well bores 12. Accordingly, additional drilling operations are not required to recover gob gas from a mined coal seam 15. Step 548 leads to the end of the process by which a coal seam 15 is efficiently degasified from the surface. The method provides a symbiotic relationship with the mine to remove unwanted gas prior to mining and to rehydrate the coal prior to the mining process.

Although the present invention has been described with several embodiments, various changes and modifications may be suggested to one skilled in the art. It is intended that the present invention encompass such changes and modifications as fall within the scope of the appended claims.

What is claimed is:

1. A subterranean well bore pattern for accessing an area of a subterranean zone from the surface, comprising:

a first well bore extending from a surface well bore substantially defining a first end of the area in the subterranean zone to a distant end of the area; and a plurality of lateral well bores extending outwardly from the first well bore, wherein a distance from an end of a lateral well bore to the surface well bore is substantially equal for each of the lateral well bores.

2. The well bore pattern of claim 1, wherein the plurality of lateral well bores comprises:

a first set of lateral well bores extending outwardly from a first side of the first well bore; and a second set of lateral well bores extending outwardly from a second side of the first well bore.

3. The well bore pattern of claim 2, further comprising a third set of lateral well bores extending outwardly from the first and second sets of lateral well bores.

4. The well bore pattern of claim 1, wherein the plurality of lateral well bores each extend to a periphery of the area.

5. The well bore pattern of claim 1, wherein each of the plurality of lateral well bores are substantially evenly spaced from each other.

6. The well bore pattern of claim 1, wherein at least one of the plurality of lateral well bores comprises:

a first radiused portion extending from the first well bore;

a second radiused portion extending from the first radiused portion; and an elongated portion extending from the second radiused portion.

7. The well bore pattern of claim 6, wherein the second radiused portion extends toward the surface well bore.

8. The well bore pattern of claim 1, wherein the area substantially comprises a quadrilateral, and wherein the ends comprise distant end of the quadrilateral.

9. The well bore pattern of claim 8, wherein each of the plurality of lateral well bores extends to a periphery of the quadrilateral.

10. A method for accessing an area of a subterranean zone from the surface, comprising:

forming a first well bore extending from a surface well bore substantially defining a first end of the area in the subterranean zone to a distant end of the area; and forming a plurality of lateral well bores extending outwardly from the first well bore, wherein a distance from an end of a lateral well bore to the surface well bore is substantially equal for each of the lateral well bores.

11. The method of claim 10, wherein forming the plurality of lateral well bores comprises:

forming a first set of lateral well bores extending outwardly from a first side of the first well bore; and forming a second set of lateral well bores extending outwardly from a second side of the first well bore.

12. The method of claim 10, wherein forming the plurality of lateral well bores comprises:

forming a first set of lateral well bores extending outwardly from a first side of the first well bore;

forming a second set of lateral well bores extending outwardly from a second side of the first well bore; and forming a third set of lateral well bores extending outwardly from the first and second sets of lateral well bores.

13. The method of claim 10, wherein forming the plurality of lateral well bores comprises extending each of the plurality of lateral well bores to a periphery of the area.

14. The method of claim 10, wherein forming the plurality of lateral well bores comprises disposing each of the plurality of lateral well bores substantially evenly spaced from each other.

15. The method of claim 10, wherein forming at least one of the plurality of lateral well bores comprises:

forming a first radiused portion extending from the first well bore;

forming a second radiused portion extending from the first radiused portion; and forming an elongated portion extending from the second radiused portion.

16. The method of claim 15, wherein forming the second radiused portion comprises extending the second radiuses portion toward the surface well bore.

17. The method of claim 10, wherein forming the first well bore and the plurality of lateral well bores comprises disposing the first well bore and the plurality of lateral well bores to form a substantially quadrilateral area, wherein the ends of the first well bore comprise distant end of the quadrilateral area.

18. The method of claim 17, wherein forming the plurality of lateral well bores further comprises extending each of the lateral well bores to a periphery of the quadrilateral area.

19. The method of claim 10, wherein forming the plurality of lateral well bores comprises:

forming a first set of lateral well bores extending outwardly from a first side of the first well bore; and forming a second set of lateral well bores extending outwardly from a second side of the first well bore, the second side opposite from the first side.

20. The method of claim 19, wherein forming the first and second sets of lateral well bores comprises forming each of the first set of lateral well bores opposite a corresponding one of the second set of lateral well bores.

21. A system for accessing a subterranean zone from the surface, comprising:

a first well bore pattern extending from a surface well bore, the first well bore pattern forming a first substantially quadrilateral area; and a second well bore pattern extending from the surface well bore, the second well bore pattern forming a second substantially quadrilateral area, and wherein a first side of the first quadrilateral area is disposed substantially in common with a first side of the second quadrilateral area.

22. The system of claim 21, wherein each of the first and second well bore patterns comprises:

a first well bore extending from the surface well bore, the first well bore extending from a first end to a distant end of a respective quadrilateral area; and a plurality of lateral well bores extending outwardly from the first well bore.

23. The system of claim 22, wherein a distance from an end of a lateral well bore to the surface well bore is substantially equal for each of the lateral well bores.

24. The system of claim 21, wherein each of the first and second well bore patterns comprises:

a first well bore extending from the surface well bore, the first well bore extending from a first end to a distant end of a respective quadrilateral area;

a first set of lateral well bores extending outwardly from the first well bore; and a second set of lateral well bores extending outwardly from the first set of lateral well bores.

25. The system of claim 21, wherein each of the first and second well bore patterns comprise:

a first well bore extending from the surface well bore, the first well bore extending from a first end to a distant end of a respective quadrilateral area; and a plurality of lateral well bores extending outwardly from the first well bore, each of the plurality of lateral well bores substantially equally spaced apart from each other.

26. The system of claim 21, further comprising a third well bore pattern extending from the surface well bore, the third well bore pattern forming a third substantially quadrilateral area, and wherein a first side of the third quadrilateral area is disposed substantially in common with a second side of the first quadrilateral area.

27. The system of claim 21, wherein each of the first and second well bore patterns comprise:

a first well bore extending from the surface well bore, the first well bore extending from a first end to a distant end of a respective quadrilateral area; and a plurality of lateral well bores extending outwardly from the first well bore, a length of each of the lateral well bores decreasing as a distance from a respective lateral well bore and the surface well bore increases.

28. A method for accessing a subterranean zone from the surface, comprising:

forming a first well bore pattern in the form of a first substantially quadrilateral area, the first well bore pattern extending from a surface well bore; and forming a second well bore pattern in the form of a second substantially quadrilateral area, the second well bore pattern extending from the surface well bore, and wherein a first side of the first quadrilateral area is disposed substantially in common with a first side of the second quadrilateral area.

29. The method of claim 28, wherein forming each of the first and second well bore patterns comprises:

forming a first well bore extending from the surface well bore, the first well bore extending from a first end to a distant end of a respective quadrilateral area; and forming a plurality of lateral well bores extending outwardly from the first well bore.

30. The method of claim 29, wherein forming the plurality of lateral well bores comprises forming the lateral well bores such that a distance from an end of a lateral well bore to the surface well bore is substantially equal for each of the lateral well bores.

31. The method of claim 28, wherein forming each of the first and second well bore patterns comprises:

forming a first well bore extending from the surface well bore, the first well bore extending from a first end to a distant end of a respective quadrilateral area;

forming a first set of lateral well bores extending outwardly from the first well bore; and forming a second set of lateral well bores extending outwardly from the first set of lateral well bores.

32. The method of claim 28, wherein forming each of the first and second well bore patterns comprises:

forming a first well bore extending from the surface well bore, the first well bore extending from a first end to a distant end of a respective quadrilateral area; and forming a plurality of lateral well bores extending outwardly from the first well bore, each of the plurality of lateral well bores substantially equally spaced apart from each other.

33. The method of claim 28, further comprising forming a third well bore pattern in the form of a third substantially quadrilateral area, the third well bore pattern extending from the surface well bore, and wherein a first side of the third quadrilateral area is disposed substantially in common with a second side of the first quadrilateral area.

34. The method of claim 28, wherein forming each of the first and second well bore patterns comprises:

forming a first well bore extending from the surface well bore, the first well bore extending from a first end to a distant end of a respective quadrilateral area; and forming a plurality of lateral well bores extending outwardly from the first well bore, a length of each of the lateral well bores decreasing as a distance from a respective lateral well bore and the surface well bore increases.

35. A system for accessing a subterranean zone from the surface, comprising:

a surface well bore extending from the surface to the subterranean zone; and a plurality of well bore patterns disposed within the subterranean zone each extending in a different direction from the surface well bore, the plurality of well bore patterns symmetrically disposed about the surface well bore.

36. The system of claim 35, wherein each of the plurality of well bore patterns comprises:

a first well bore extending outwardly from the surface well bore; and a plurality of lateral well bores extending outwardly from the first well bore.

37. The system of claim 36, wherein the lateral well bores are disposed substantially evenly spaced apart from each other.

38. The system of claim 36, wherein a length of a respective lateral well bore decreases as a distance from the respective lateral well bore to the surface well bore increases.

39. The system of claim 36, wherein a distance from each of the lateral well bores to the surface well bore is substantially equal.

40. The system of claim 35, wherein each of the plurality of well bore patterns forms a substantially quadrilateral shape.

41. The system of claim 35, wherein each of the well bore patterns comprises:

a first well bore extending from the surface well bore;

a first set of lateral well bores extending outwardly from a first side of the first well bore; and a second set of lateral well bores extending outwardly from a second side of the first well bore.

42. The system of claim 41, wherein each of the first set of lateral well bores is disposed opposite a corresponding one of the second set of lateral well bores.

43. A method for accessing a subterranean zone from the surface, comprising:

forming a surface well bore extending from the surface to the subterranean zone; and forming a plurality of well bore patterns disposed within the subterranean zone each extending in a different direction from the surface well bore, the plurality of well bore patterns symmetrically disposed about the surface well bore.

44. The method of claim 43, wherein forming each of the plurality of well bore patterns comprises:

forming a first well bore extending outwardly from the surface well bore; and forming a plurality of lateral well bores extending outwardly from the first well bore.

45. The method of claim 44, wherein forming the lateral well bores comprises disposing each of the lateral well bores substantially evenly spaced apart from each other.

46. The method of claim 44, wherein forming the lateral well bores comprises forming each lateral well bore such that a length of the lateral well bore decreases as a distance from the respective lateral well bore to the surface well bore increases.

47. The method of claim 44, wherein forming the lateral well bores comprises forming each of the lateral well bores such that a distance from each of the lateral well bores to the surface well bore is substantially equal.

48. The method of claim 43, wherein forming each of the plurality of well bore patterns comprises forming each of the plurality of well bore patterns having a substantially quadrilateral shape.

49. The method of claim 43, wherein forming each of the well bore patterns comprises:

forming a first well bore extending from the surface well bore;

forming a first set of lateral well bores extending outwardly from a first side of the first well bore; and forming a second set of lateral well bores extending outwardly from a second side of the first well bore.

50. The method of claim 49, wherein forming the first and second sets of lateral well bores comprises forming each of the first set of lateral well bores opposite a corresponding one of the second set of lateral well bores.

51. A system for accessing a subterranean zone from the surface, comprising:

a first well bore pattern disposed within the subterranean zone extending from a first surface well bore; and a second well bore pattern disposed within the subterranean zone extending from a second surface well bore, the first and second well bore patterns configured to nest adjacent each other within the subterranean zone.

52. The method of claim 51, wherein each of the first and second well bore patterns comprises:

a first well bore extending from a respective surface well bore; and a plurality of lateral well bores extending outwardly from the first well bore.

53. The system of claim 51, wherein each of the first and second well bore patterns comprises:

a plurality of main well bores extending outwardly from a respective surface well bore; and a plurality of lateral well bores extending outwardly from each of the plurality of main well bores.

54. The system of claim 53, wherein the plurality of main well bores are symmetrically disposed about the respective surface well bore.

55. The system of claim 53, wherein a length of each of the lateral well bores decreases as a distance between the respective lateral well bore and a respective surface well bore increases.

56. The system of claim 51, wherein each of the first and second well bore patterns comprises:

a plurality of main well bores extending outwardly from a respective surface well bore;

a first set of lateral well bores extending outwardly from a first side of each of the plurality of main well bores; and a second set of lateral well bores extending outwardly from a second side of each of the main well bores.

57. The system of claim 56, wherein each of the first set of lateral well bores is disposed opposite a corresponding one of the second set of lateral well bores.

58. A method for accessing a subterranean zone from the surface, comprising:

forming a first well bore pattern extending from a first surface well bore and disposed within the subterranean zone; and forming a second well bore pattern extending from a second surface well bore and disposed within the subterranean zone, the first and second well bore patterns arranged to nest adjacent each other within the subterranean zone.

59. The method of claim 58, wherein forming each of the first and second well bore patterns comprises:

forming a first well bore extending from a respective surface well bore; and forming a plurality of lateral well bores extending outwardly from the first well bore.

60. The method of claim 58, wherein forming each of the first and second well bore patterns comprises:

forming a plurality of main well bores extending outwardly from a respective surface well bore; and forming a plurality of lateral well bores extending outwardly from each of the plurality of main well bores.

61. The method of claim 60, wherein forming the plurality of main well bores comprises forming the plurality of main well bores symmetrically disposed about the respective surface well bore.

62. The method of claim 60, wherein forming the lateral well bores comprises forming each of the lateral well bores having a length that decreases as a distance between the respective lateral well bore and a respective surface well bore increases.

63. The method of claim 58, wherein forming each of the first and second well bore patterns comprises:

forming a plurality of main well bores extending outwardly from a respective surface well bore;

forming a first set of lateral well bores extending outwardly from a first side of each of the plurality of main well bores; and forming a second set of lateral well bores extending outwardly from a second side of each of the main well bores.

64. The method of claim 63, wherein forming each of the first set of lateral well bores comprises forming each of the first set of lateral well bores opposite a corresponding one of the second set of lateral well bores.

65. A method for accessing a subterranean zone from the surface, comprising:

forming a first well bore extending from the surface to the subterranean zone;

forming a second well bore extending from the surface to the subterranean zone, the second well bore intersecting the first well bore at a junction proximate the subterranean zone;

forming a well bore pattern within the subterranean zone extending from the junction using a drill string extending downwardly through the second well bore;

supplying drilling fluid downwardly through the drill string to remove cuttings generated by the drill string; and minimizing down-hole pressure within the subterranean zone by pumping the drilling fluid and the cuttings to the surface through the first well bore.

66. The method of claim 65, wherein forming the second well bore comprises forming the second well bore offset from the first well bore at the surface.

67. The method of claim 65, wherein forming the second well bore comprises forming the second well bore extending from the first well bore at a location between the surface and the subterranean zone.

68. The method of claim 65, wherein forming the well bore pattern comprises:

forming a main well bore extending from the junction; and forming a plurality of lateral well bores extending outwardly from the main well bore.

69. The method of claim 65, wherein forming the well bore pattern comprises:

forming a main well bore extending from the junction;

forming a first plurality of lateral well bores extending outwardly from the main well bore; and forming a second plurality of lateral well bores extending from the first plurality of lateral well bores.

70. The method of claim 65, wherein forming the well bore pattern comprises:

forming a main well bore extending from the junction; and forming a plurality of lateral well bores extending outwardly from the main well bore, a length of each of the lateral well bores decreasing as a distance from the respective lateral well bore and the junction increases.

71. The method of claim 65, further comprising forming an enlarged cavity at the junction of the first and second well bores.

* * * * *

UNITED STATES PATENT AND TRADEMARK OFFICE

CERTIFICATE OF CORRECTION

PATENT NO. : 6,598,686 B1
DATED : July 29, 2003
INVENTOR(S) : Joseph A. Zupanick It is certified that error appears in the above-identified patent and that said Letters Patent is hereby corrected as shown below:

Title page,
Item [63] Related U.S. Application Data, delete "Continuation of application No. 09/696,338" and insert -- Continuation-in-part of application No. 09/696,338 --.

Signed and Sealed this

Thirteenth Day of July, 2004

JON W. DUDAS
*Acting Director of the United States Patent and Trademark Office*